US011265645B2

(12) United States Patent
Pavlov et al.

(10) Patent No.: US 11,265,645 B2
(45) **Date of Patent: *Mar. 1, 2022**

(54) ACOUSTIC CHAMBERS DAMPED WITH SIDE-BRANCH RESONATORS, AND RELATED SYSTEMS AND METHODS

(71) Applicant: Apple Inc., Cupertino, CA (US)

(72) Inventors: Peter M. Pavlov, Culver City, CA (US); John R. Bruss, Culver City, CA (US); Duy P. Le, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/140,350

(22) Filed: Sep. 24, 2018

(65) Prior Publication Data

US 2020/0100021 A1 Mar. 26, 2020

(51) Int. Cl.
*H04R 1/28* (2006.01)
*H04R 9/06* (2006.01)
(Continued)

(52) U.S. Cl.
CPC ..... *H04R 1/2811* (2013.01); *H04R 1/025* (2013.01); *H04R 1/1016* (2013.01);
(Continued)

(58) Field of Classification Search
CPC .... H04R 1/025; H04R 1/2811; H04R 1/2819; H04R 1/2826; H04R 1/2842;
(Continued)

(56) References Cited

U.S. PATENT DOCUMENTS 4,239,945 A * 12/1980 Atoji ..... H04R 1/2819 381/349
4,298,087 A * 11/1981 Launay ..... H04R 1/345 181/153
(Continued)

FOREIGN PATENT DOCUMENTS

CN 1134651 10/1996
CN 101494808 7/2009
(Continued)

OTHER PUBLICATIONS

Notice of Allowance in U.S. Appl. No. 15/917,426, dated May 16, 2019, 8 pages.
(Continued)

*Primary Examiner* — Huyen D Le
(74) *Attorney, Agent, or Firm* — Morgan, Lewis & Bockius LLP

(57) ABSTRACT

An acoustic enclosure includes a housing at least partially defining an acoustic chamber for an acoustic radiator. The housing further defines an acoustic opening from the acoustic chamber to a surrounding environment. The acoustic enclosure also has a first acoustic resonator and a second acoustic resonator. The first acoustic resonator and the second acoustic resonator are acoustically coupled with the acoustic chamber in parallel relative to each other. Each of the first acoustic resonator and the second acoustic resonator modifies a frequency response of the acoustic chamber. Loudspeakers can include such an enclosure acoustically excited or driven by an electro-acoustic transducer. As well, an electronic device can include such a loudspeaker.

24 Claims, 12 Drawing Sheets

(51) Int. Cl.
*H04R 1/02* (2006.01)
*H04R 1/10* (2006.01)

(52) U.S. Cl.
CPC ..... *H04R 1/1075* (2013.01); *H04R 1/2826* (2013.01); *H04R 1/2842* (2013.01); *H04R 1/2849* (2013.01); *H04R 9/06* (2013.01)

(58) Field of Classification Search
CPC .... H04R 1/2849; H04R 9/06; H04R 2400/11; H04R 1/1016; H04R 1/1075; H04R 1/1083; H04R 1/2876; H04R 1/2888; H04R 9/025
USPC ..... 381/345, 349, 350, 351, 353, 354; 181/153, 155, 156, 160, 199
See application file for complete search history.

(56) References Cited

U.S. PATENT DOCUMENTS

| | | | | |
|---|---|---|---|---|
| 4,953,655 | A * | 9/1990 | Furukawa | H04R 1/2819 181/156 |
| 5,012,890 | A | 5/1991 | Nagle et al. | |
| 5,261,006 | A * | 11/1993 | Nieuwendijk | H04R 1/227 381/353 |
| 5,406,637 | A * | 4/1995 | Gonzalez | H04R 1/2826 181/156 |
| 5,479,520 | A | 12/1995 | Nieuwendijk et al. | |
| 5,514,841 | A | 5/1996 | Rochon | |
| 5,778,081 | A | 7/1998 | Patrick | |
| 5,996,733 | A | 12/1999 | Detuncq | |
| 6,473,625 | B1 | 10/2002 | Williams et al. | |
| 7,740,104 | B1 | 6/2010 | Parkins et al. | |
| 8,300,871 | B2 | 10/2012 | Welsh et al. | |
| 9,936,284 | B2 | 4/2018 | Howes et al. | |
| 10,397,693 | B1 * | 8/2019 | Tao | H04R 1/2811 |
| 2009/0116676 | A1 | 5/2009 | Welsh et al. | |
| 2017/0332167 | A1 | 11/2017 | Liu et al. | |
| 2018/0081406 | A1 | 3/2018 | Kita et al. | |

FOREIGN PATENT DOCUMENTS

| | | |
|---|---|---|
| CN | 103220608 | 7/2013 |
| CN | 10475441 | 7/2015 |
| CN | 104754454 | 7/2015 |
| CN | 204993827 | 1/2016 |
| CN | 105474662 | 4/2016 |
| CN | 107371107 | 11/2017 |
| CN | 207070332 | 3/2018 |
| EP | 1685741 | 4/2013 |
| GB | 2408405 | 5/2005 |

OTHER PUBLICATIONS

Office Action in Chinese Application No. 201910176406.8, dated May 28, 2020, 11 pages.

* cited by examiner

ACOUSTIC CHAMBERS DAMPED WITH SIDE-BRANCH RESONATORS, AND RELATED SYSTEMS AND METHODS

FIELD

This application and related subject matter (collectively referred to as the "disclosure") generally concern acoustic chambers damped with one or more side-branch resonators, and related systems and methods. More particularly, but not exclusively, this disclosure pertains to loudspeaker enclosures defining an acoustic chamber acoustically coupled with two or more side-branch resonators, with each respective side-branch resonator being configured to damp a corresponding resonant frequency.

BACKGROUND INFORMATION

Typical electro-acoustic transducers have an acoustic radiator and typical loudspeakers pair such an acoustic radiator with an acoustic chamber to accentuate and/or to damp selected acoustic frequency bands. Conventional acoustic chambers and acoustic radiators often are large compared to many electronic devices.

For example, many commercially available electronic devices have a characteristic length scale equivalent to or smaller than a characteristic length scale of conventional acoustic chambers and acoustic radiators. Representative electronic devices include, by way of example, portable personal computers (e.g., smartphones, smart speakers, laptop, notebook and tablet computers), desktop personal computers, and wearable electronics (e.g., smart watches).

Consequently, many electronic devices do not incorporate conventional acoustic radiators and acoustic chambers, given their incompatible size differences. As a further consequence, some electronic devices do not provide an audio experience to users on par with that provided by more conventional, albeit larger, loudspeakers.

SUMMARY

In some respects, concepts disclosed herein concern acoustic enclosures having an acoustic chamber damped with plural resonant chambers.

According to one aspect, an acoustic enclosure includes a housing at least partially defining an acoustic chamber for an acoustic radiator. The housing further defines an acoustic opening from the acoustic chamber to a surrounding environment. The acoustic enclosure also includes a first acoustic resonator and a second acoustic resonator. The first acoustic resonator and the second acoustic resonator are acoustically coupled with the acoustic chamber in parallel relative to each other. Each of the first acoustic resonator and the second acoustic resonator modifies a frequency response of the acoustic chamber.

The first acoustic resonator can be arranged to resonate at a corresponding first frequency and the second acoustic resonator can be arranged to resonate at a corresponding second frequency.

The first acoustic resonator can include a first resonant chamber and a first duct extending from the acoustic chamber to the first resonant chamber. The second acoustic resonator can include a second resonant chamber and a second duct extending from the acoustic chamber to the second resonant chamber. Alternatively, the second duct can extend from the first duct to the second resonant chamber.

As another alternative, the second acoustic resonator can include a resonant conduit extending from a proximal end to a distal end. The proximal end can be acoustically coupled with the acoustic chamber. The distal end can be open to a surrounding environment or closed to a surrounding environment.

The first acoustic resonator can include a first resonant conduit extending from a proximal end to a distal end. The proximal end of the first resonant conduit can be acoustically coupled with the acoustic chamber. The second acoustic resonator also can include a second resonant conduit extending from a proximal end to a distal end. The distal end of the first resonant conduit can be open to a surrounding environment, and the distal end of the second resonant conduit can be open to the surrounding environment. Alternatively, the distal end of the first resonant conduit can be open to a surrounding environment, and the distal end of the second resonant conduit can be closed to the surrounding environment. As yet another alternative, both distal ends can be closed to a surrounding environment. In one aspect, the first resonant conduit can extend longitudinally within the second resonant conduit.

The first resonant conduit and the second resonant conduit can be spaced apart from each other to define a longitudinally extending gap between the first resonant conduit and the second resonant conduit. The longitudinally extending gap can be acoustically coupled with the acoustic chamber at a position adjacent the proximal end of the second resonant conduit.

The housing can include a shell member and a complementarily configured insert. The shell member can be configured to receive the insert in a mating engagement. When matingly engaged with each other, the shell member and the insert can define an outer boundary of at least a portion of the first acoustic resonator. The insert can define a through-hole aperture open to the acoustic chamber and the portion of the first acoustic resonator defined by the shell member and the insert. The portion of the first acoustic resonator defined by the shell member and the insert can include a resonant chamber and the aperture can provide a contraction positioned between the acoustic chamber and the resonant chamber. Alternatively, the portion of the first acoustic resonator defined by the shell member and the insert can include a resonant conduit and the aperture can further open to the resonant conduit such that the aperture extends the resonant conduit to the acoustic chamber.

The shell member can define a through-hole aperture extending from the resonant conduit to a surrounding environment. An acoustic mesh can be positioned over the through-hole aperture defined by the shell member.

According to another aspect, electronic devices are described. An electronic device can include an electro-acoustic transducer and circuitry to drive the electro-acoustic transducer to emit sound over a selected frequency bandwidth. For example, such circuitry can include a processor and a memory. The memory can contain instructions that, when executed by the processor, cause the electronic device to drive the electro-acoustic transducer to emit sound over the selected frequency bandwidth. A ported acoustic chamber is positioned adjacent the electro-acoustic transducer, and an acoustic resonator has a first side-branch resonator and a second side-branch resonator. The first side-branch resonator and the second-side-branch resonator are acoustically coupled with the acoustic chamber in parallel relative to each other. Such an arrangement can damp respective first and second frequencies corresponding to a tuning of the first side-branch resonator and the second side-branch resonator.

Also disclosed are associated methods, as well as tangible, non-transitory computer-readable media including computer executable instructions that, when executed, cause an audio appliance to implement one or more methods disclosed herein. Digital signal processors embodied in software, firmware, or hardware and being suitable for implementing such instructions also are described.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

In FIG. 5A, one of the resonators is at least partially surrounded by the other of the resonators.

In FIG. 5B, one of the resonators is at least partially surrounded by the other of the resonators.

FIG. 19 illustrates a block diagram showing aspects of an audio appliance.

DETAILED DESCRIPTION

The following describes various principles related to acoustic chambers damped with one or more side-branch resonators, and related systems and methods. For example, some disclosed principles pertain to acoustic systems, methods, and components to damp resonance at certain frequencies, extending a frequency response of an acoustic enclosure. That said, descriptions herein of specific appliance, apparatus or system configurations, and specific combinations of method acts, are but particular examples of contemplated appliances, components, systems, and methods chosen as being convenient illustrative examples of disclosed principles. One or more of the disclosed principles can be incorporated in various other appliances, components, systems, and methods to achieve any of a variety of corresponding, desired characteristics. Thus, a person of ordinary skill in the art, following a review of this disclosure, will appreciate that appliances, components, systems, and methods having attributes that are different from those specific examples discussed herein can embody one or more presently disclosed principles, and can be used in applications not described herein in detail. Such alternative embodiments also fall within the scope of this disclosure.

I. Overview

Electronic devices can include one or more electro-acoustic transducers to emit sound. Given size constraints, some electronic devices incorporate electro-acoustic transducers configured as so-called "micro-speakers." Examples of micro-speakers include a speakerphone speaker or an earpiece receiver found within an in-ear earphone, headphone, smart-phone, or other similar compact electronic device, such as, for example, a portable time-piece, or a tablet-, notebook-, or laptop-computer.

Figure 1:
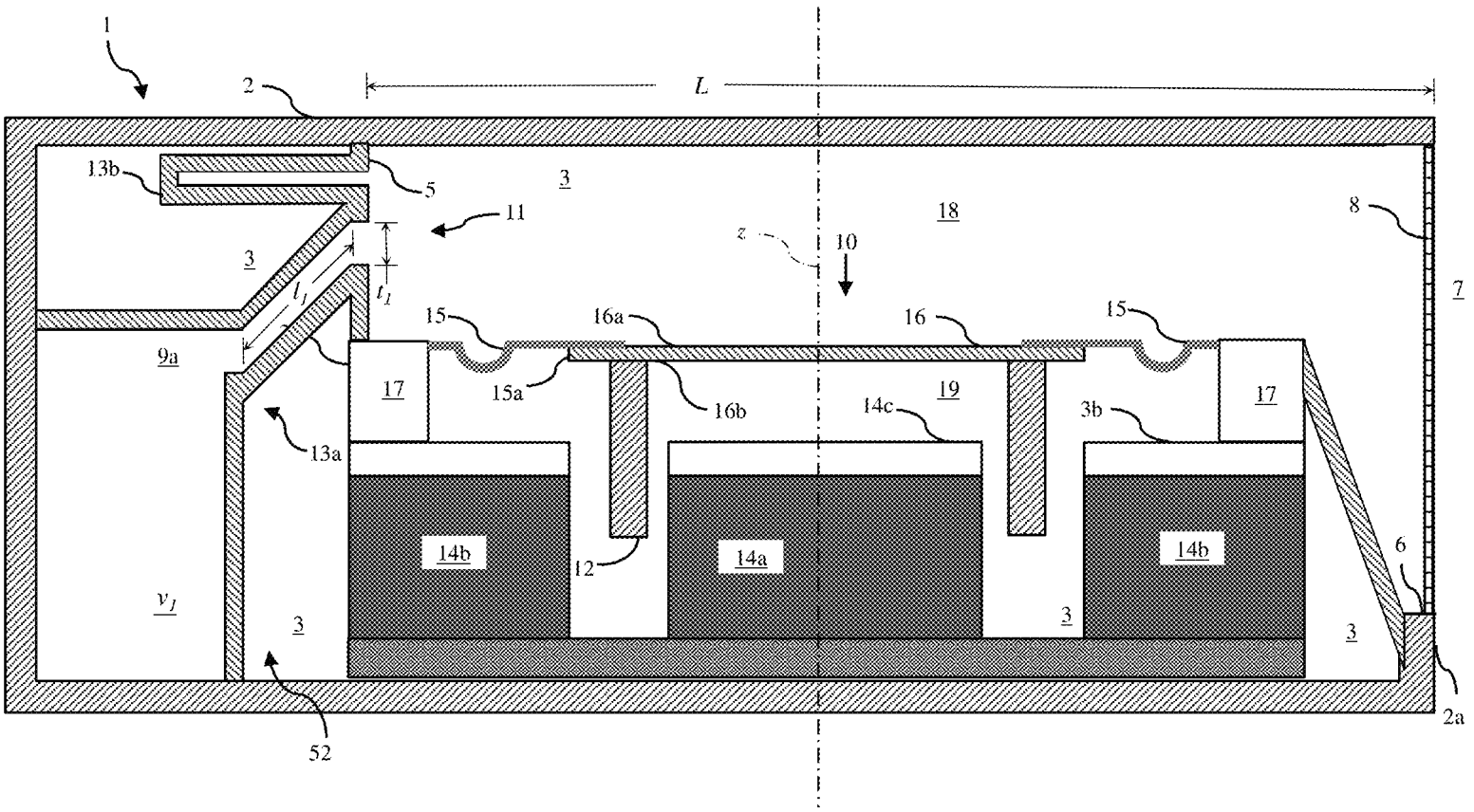
FIG. 1 illustrates a cross-sectional view of a damped acoustic enclosure and a loudspeaker transducer.

Micro-speakers operate on principles similar, but not necessarily identical, to larger electro-acoustic transducers. For example, as shown in FIG. 1, a micro-speaker 10 can incorporate a voice coil 12 and one or more corresponding magnets 14*a*, 14*b*$_{[MOU1]}$ to cause the voice coil to reciprocate in correspondence with variations in electrical current through the voice coil. Although FIG. 1 shows inner and outer magnets 14*a*, 14*b*, another loudspeaker may have an inner magnet 14*a*, and the illustrated structure 14*b* may be iron. Alternatively, another loudspeaker may have an outer magnet 14*b* and the illustrated structure 14*a* may be iron.

In any event, such micro-speakers can have a diaphragm 16 or other acoustic radiator so coupled with the voice coil 12 as to cause the acoustic radiator to emit sound as the voice coil reciprocates. However, given their limited physical size, output levels attainable by micro-speakers are limited. Some electronic devices acoustically couple such a micro-speaker with one or more open regions suitable for improving radiated sound, as in the nature of an acoustic chamber 18. A diameter or major axis of a non-circular micro-speaker diaphragm can measure, for example, between about 3 mm and about 75 mm, such as between about 15 mm and about 65 mm, for example, between about 20 mm and about 50 mm.

Figure 2:
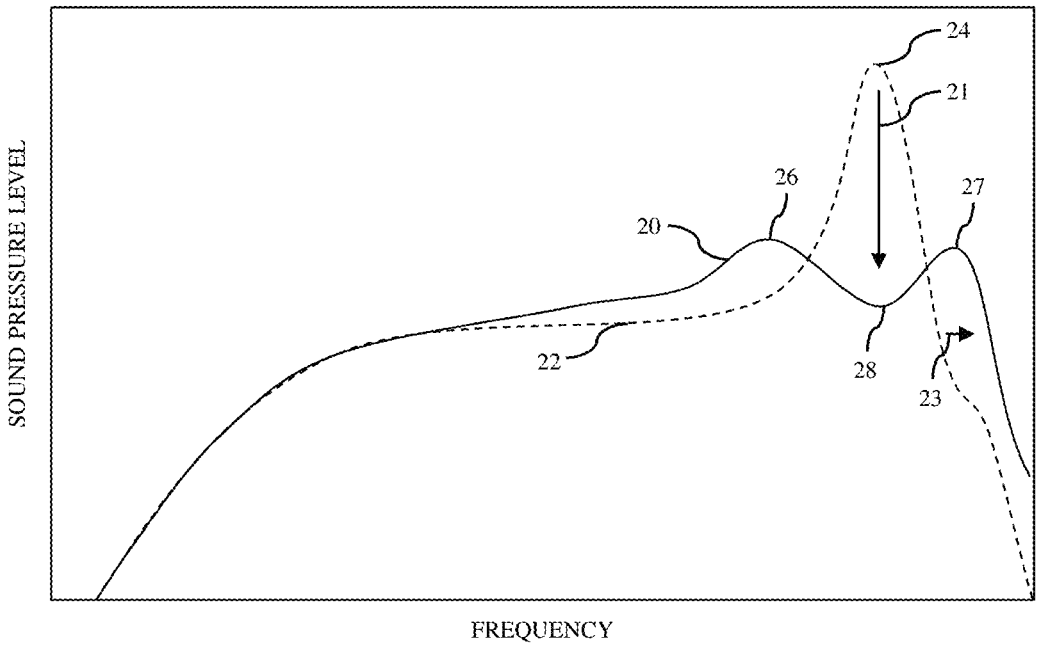
FIG. 2 illustrates a frequency response of an acoustic enclosure damped with an acoustic resonator and a frequency response of an acoustic enclosure without such damping.

An acoustic chamber 18 or other acoustic system can be characterized by a range of frequencies (sometimes referred to in the art as a "bandwidth" or a "frequency response"), as shown in FIG. 2, over which observed sound-pressure level (SPL) 20, 22 losses are less than a selected threshold level. Sometimes, a loss of less than three decibels (−3 dB) SPL is used to characterize the bandwidth provided by a given acoustic enclosure or other system.

An acoustic frequency having a quarter-wavelength substantially equal to a characteristic length of a ported acoustic chamber can resonate (e.g., form a standing wave) within the chamber, making radiated sound louder at that frequency than at other frequencies. The frequency at which this occurs is sometimes referred to in the art as the "Quarter Wave Resonance (QWR) frequency," which represents a unit-of-measure for a given acoustic chamber and can differ among chambers with different geometries.

Additionally, an acoustic wave propagating at the QWR frequency (or above) can be 180-degrees out-of-phase relative to a loudspeaker diaphragm or other acoustic radiator exciting an air mass in the acoustic chamber. Consequently, sound loudness can rapidly decay at frequencies beyond the QWR frequency for a given acoustic chamber and negatively affect a perceived quality of sound radiated by the acoustic chamber. Such a decay in sound-pressure level is shown in FIG. 2 to the right of peak 24 and to the right of peak 27.

Referring again to FIGS. 1 and 2, an acoustic chamber 18 providing a relatively wider bandwidth 20 compared to a bandwidth 22 provided by another acoustic chamber (not shown) may be perceived as providing relatively better sound quality than the other chamber. As described more fully herein, one or more side-branch resonators 13*a*, 13*b* acoustically coupled with an acoustic chamber 18 can damp resonance at certain frequencies, as indicated by the arrow 21, and extend a frequency response, as indicated by the arrow 23, of the acoustic chamber compared to acoustic chambers that lack such damping. Consequently, an acoustic enclosure and/or an electronic device having an acoustic chamber damped with plural resonators can improve perceived sound quality compared to previous enclosures and/or devices.

In certain exemplary embodiments described more fully below, an in-ear earphone can have an acoustic chamber 18 partially bounded by a major surface 16*a* of a loudspeaker diaphragm 16. The acoustic chamber can have an open port or vent 6 arranged to direct sound into a wearer's ear canal 7. The earphone also can define one or more ducts, conduits, channels, grooves, chambers, ports, or combinations thereof, acoustically coupled with the acoustic chamber 18. The arrangement of the one or more ducts, conduits, channels, grooves, chambers, ports, or combinations thereof, can modify a frequency response of the acoustic chamber 18, and thus modify sound perceived by the wearer.

For example, the arrangement of the one or more ducts, conduits, channels, grooves, chambers, ports, or combinations thereof, can damp the frequency response of the acoustic chamber 18 at one or more, e.g., resonant, frequencies. Such damping can de-emphasize otherwise dominant frequencies and flatten the overall frequency response of the earphone. As well, or alternatively, such damping can extend a frequency response of the earphone. An earphone (or other loudspeaker enclosure) with a flattened and/or extended frequency response may be subjectively perceived by a wearer (or other user) as providing "better" sound quality than an earphone (or other enclosure) having one or more resonant peaks in its frequency response. Accordingly, such damping can provide a perceptually improved listening experience for an earphone wearer (or other user), requiring less equalization or other signal processing by, e.g., a media device.

II. Electro-Acoustic Transducers

There are numerous types of electro-acoustic transducers or drivers for loudspeakers (or micro-speakers).

Referring still to FIG. 1, a traditional direct radiator, for example, can include an electrodynamic loudspeaker 10 having a coil 12 of electrically conductive wire (sometimes referred to in the art as a "voice coil") immersed in a static magnetic field, e.g., associated with the magnets 14*a*, 14*b*, and coupled to a diaphragm 16 and a suspension system 15. The conductive wire (e.g., copper clad aluminum) is sometimes referred to as a "voice coil wire."

One or more magnets 14*a*, 14*b* (e.g., an NdFeB magnet) can be so positioned adjacent the voice coil 12 as to cause a magnetic field of the magnet(s) 14*a*, 14*b* to interact with a magnetic flux corresponding to an electrical current through the voice coil 12. In the particular embodiment shown in FIG. 1, the voice coil 12 is positioned between an inner magnet 14*a* and an outer magnet 14*b*. With the configuration in FIG. 1, the voice coil 12 is configured to move pistonically to and fro between a distal-most position and a proximal-most position relative to the inner magnet 14*a*.

With loudspeakers as in FIG. 1, the diaphragm 16 and the coil 12 are movable in correspondence with each other. As current alternates in direction through the voice coil 12, mechanical forces develop between the magnetic fields of the voice coil 12 and the magnet(s) 14*a*, 14*b*, urging the voice coil (and thus the diaphragm 16) to move, e.g., to reciprocate. As the respective current or voltage potential alternates, e.g., at an audible frequency, the voice coil 12 (and diaphragm 16) can move, e.g., reciprocate pistonically, and radiate sound.

The transducer module 10 has a frame 17 and a suspension system 15 supportively coupling the acoustic diaphragm 16 with the frame. The diaphragm 16 can be stiff (or rigid) and lightweight. Ideally, the diaphragm 16 exhibits perfectly pistonic motion. The diaphragm, sometimes referred to as a cone or a dome, e.g., in correspondence with its selected shape, may be formed from aluminum, tungsten, paper, plastic, composites, or other materials that provide high stiffness, low mass, and are suitably formable during manufacture.

The suspension system 15 generally provides a restoring force to the diaphragm 16 following an excursion driven by interactions of the magnetic fields from the voice coil 12 and the magnet(s) 14*a*, 14*b*. Such a restoring force can return the diaphragm 16 to a neutral position, e.g., as shown in FIG. 1. The suspension system 15 can maintain the voice coil 12 in a desired range of positions relative to the magnet(s) 14*a*, 14*b*. For example, the suspension 15 can provide for controlled axial motion along an axis, z, transverse to the diaphragm 16 (e.g., pistonic motion) of the diaphragm 16 and voice coil 12 while largely preventing lateral motion or tilting that could cause the coil to strike other motor components, such as, for example, the magnet(s) 14*a*, 14*b*.

A measure of resiliency (e.g., a position-dependent stiffness) of the suspension 15 can be chosen to match a force vs. deflection characteristic of the voice coil 12 and motor (e.g., magnet 14*a*, 14*b*) system. The illustrated suspension system 15 includes a surround extending outward of an outer periphery 15*a* of the diaphragm 16. The surround member can be formed from a polyurethane foam material, a silicone material, or other pliant material. In some instances, the surround may be compressed into a desired shape by heat and pressure applied to a material in a mold or die.

The diaphragm 16 has a first major surface 16*a* partially bounding the acoustic chamber 18, and an opposed second major surface 16*b*. A first end of the voice coil 12 can be chemically or otherwise physically bonded to the second major surface 16*b* of the acoustic diaphragm 16. For example, in FIG. 1, a voice coil 12 is physically coupled with the second major surface 16*b*.

Alternatively, a voice coil wire can be wrapped around a non-conductive bobbin, sometimes referred to as a "voice coil former." The voice coil former (not shown) can be integral with or physically attached, e.g., bonded, to the major surface 16*b* of the acoustic diaphragm 16. Such a voice coil former can provide a platform for transmitting mechanical force and mechanical stability to the diaphragm 16, generally as described above in connection with the voice coil.

The voice coil 12 and/or the voice coil former can have a cross-sectional shape corresponding to a shape of the major surface of the diaphragm 16. For example, the diaphragm 16 can have a substantially circular, rectilinear, ovular, race-track or other shape when viewed in plan from above (or below). Similarly, the voice coil (or voice coil former) can have a substantially circular, rectilinear, ovular, race-track or other cross-sectional shape. In other instances, the cross-sectional shape of the voice coil former can differ from a shape of the diaphragm when viewed in plan from above (or below).

Other forms of driver are contemplated for use in connection with disclosed technologies. For example, piezo-electric drivers, ribbon drivers, and other flexural transducers can suspend an electro-responsive diaphragm within a frame. The diaphragm can change dimension or shape or otherwise deflect responsive to an electrical current or an electrical potential applied across the diaphragm (or other member physically coupled (directly or indirectly) with the diaphragm). As in the case of piezo-electric transducers, the deflection can arise by virtue of internal mechanical forces arising in correspondence to electrical current or potential. As in the case of, for example, electrostatic (or planar-magnetic) transducers, mechanical forces between a diaphragm and a stator arise by virtue of variations in electrostatic fields between the diaphragm and the stator, urging the diaphragm to vibrate and radiate sound.

And, although not shown, loudspeaker transducers can include other circuitry (e.g., application-specific integrated circuits (ASICs)) or electrical devices (e.g., capacitors, inductors, and/or amplifiers) to condition and/or drive electrical signals through the voice coil. Such circuitry can constitute a portion of a computing environment or audio appliance described herein.

III. Acoustic Enclosures

Referring still to FIG. 1, the loudspeaker module 10 is positioned in an acoustic enclosure 1. The acoustic enclosure 1 can be a stand-alone apparatus, as in the case of, for example, a traditional bookshelf speaker or a smart speaker. Alternatively, the acoustic enclosure 1 can constitute a defined region within an encasement of another device, such as, for example, a smart phone or a tablet computer. In still other alternative embodiments, the acoustic enclosure can constitute a portion of an in-ear earphone, on on-ear headphone, or an over-the-ear headphone.

In any event, the acoustic enclosure 1 in FIG. 1 includes a housing 2 defining an open interior region 3. The loudspeaker diaphragm 16, or more generally, the acoustic radiator, is positioned in the open interior region 3 and defines a first major surface 16*a* and an opposed second major surface 16*b*. In FIG. 1, the open interior region 3 is partitioned by several walls 5 and the loudspeaker diaphragm 16 into an acoustic chamber 18 adjacent the first major surface 16*a* and an acoustically-sealed acoustic chamber 19 adjacent the second major surface 16*b*. In FIG. 1, the acoustic chamber 18 and the acoustically-sealed acoustic chamber 19 are at least partially bounded by the first major surface 16*a* and the second major surface 16*b*, respectively.

The housing 2 also defines an acoustic port 6 from the acoustic chamber 18 to a surrounding environment 7. The port 6 and diaphragm 16 can be arranged in a so-called "side firing" arrangement, as in FIG. 1. That is to say, a cross-section (or mouth) of the port 6 can be oriented transversely relative to a major surface 16*a*, 16*b* of the diaphragm 16. For example, in FIG. 1, the port 6 is oriented such that a vector normal to the mouth of the port extends orthogonally relative to a vector normal to the loudspeaker diaphragm 16.

Although the illustrated acoustic port 6 has a cover 8 or other protective barrier to inhibit intrusion of dirt, water, or other debris into the acoustic chamber 18, some acoustic ports have no distinct cover. For example, rather than defining a single aperture as in FIG. 1, the housing 2 can define a perforated wall (not shown) extending across the mouth of the port 6.

Although the acoustic port 6 is illustrated in FIG. 1 generally as being an aperture defined by the housing wall, in some instances, the acoustic port 6 includes an acoustic duct or channel extending from the acoustic chamber 18 to an outer surface 2*a* of the housing 2 or other encasement. For example, aesthetic or other design constraints for an electronic device may cause the acoustic chamber 18 to be spaced apart from the outer surface 2*a* of the housing or other encasement. Consequently, a duct or other acoustic channel (not shown) can extend from the acoustic chamber 18 to the outer surface to acoustically connect the acoustic chamber 18 to the surrounding environment 7. Although not shown, such a duct can have internal baffles to define a circuitous path from a proximal end adjacent the acoustic chamber 18 to a distal end adjacent the outer surface 2*a*.

As shown in FIG. 1, the acoustic chamber 18 has a characteristic length, L, extending between an interior housing wall 5 and the mouth of the port 6. In general, a fundamental (or QWR) frequency of an acoustic chamber 18 with a characteristic length, L, is a frequency, f, having a wavelength, λ, equal to 4*L. Stated differently, a resonant frequency, $f_{res}$, for a typical ported acoustic chamber 18 can be estimated according the following relationship:

$$f_{res}=c/4L$$

where c is about 343 m/s, the approximate speed of sound in air, at sea level and at a temperature of 20° C. FIG. 2 shows a representative frequency response 22 for such a ported acoustic chamber 18. Note the rapid loss of sound pressure level (SPL) at frequencies above $f_{res}$ where SPL reaches a local maximum 24.

However, the enclosure 1 shown in FIG. 1 also includes an acoustic resonator 11 acoustically coupled with the acoustic chamber 18. The resonator can be configured to resonate at a frequency substantially identical to $f_{res}$ for the acoustic chamber 18. Alternatively, the resonator 11 can be configured to resonate one or more frequencies different from $f_{res}$ for the acoustic chamber 18.

An acoustic resonator 11 coupled with the acoustic chamber 18 tends to damp a frequency response of the acoustic chamber 18 at the resonator's resonant frequency. When the resonant frequency of the resonator 11 matches $f_{res}$, the local peak 24 (FIG. 2) at $f_{res}$ can be diminished. Stated differently, the presence and configuration of the acoustic resonator 11 can spread the energy that otherwise would be concentrated at the frequency, $f_{res}$, over a wider range of frequencies. Consequently, the sound loudness, or level, radiated by the diaphragm 16 and emitted by the acoustic enclosure 1 does not increase at or near the QWR frequency, $f_{res}$, as dramatically as would otherwise be radiated and emitted at or near that frequency absent the acoustic resonator. Moreover, the damped enclosure 1 can maintain a loudness or level over a wider range of frequencies, or bandwidth, 20 compared to a bandwidth 22 attained without damping.

To further illustrate, FIG. 2 shows a representative frequency response 20 for a ported acoustic chamber damped with a resonator 11 as shown in FIG. 1 and just described. The response 20 corresponding to the damped acoustic chamber 18 has both a lower peak SPL 26, 27 and an extended bandwidth 23 compared to the representative response for an acoustic chamber without damping by an acoustic resonator.

More particularly, the peak 24 depicts the increased sound level at the QWR frequency, $f_{res}$, for the un-damped enclosure. As well, the rapid decay in level at frequencies above $f_{res}$, depicts fall-off in sound loudness at those higher frequencies. Referring now to the frequency response 20 for the damped acoustic chamber 18, the sound loudness 28 at $f_{res}$ is substantially lower than at the peak 24, yet is similar in magnitude to sound loudness at lower frequencies. Nonetheless, the sound loudness modestly increases over narrow frequency bands above and below $f_{res}$ (depicted by peaks 26, 27) for the acoustic chamber 18 damped with the acoustic resonator 11.

Some acoustic resonators 11 coupled with the acoustic chamber 18 include a plurality of constituent resonant structures coupled in series and/or in parallel with each other relative to the acoustic chamber 18. An acoustic resonator 11 having a plurality of constituent resonant structures 13*a*, 13*b* acoustically coupled with each other in parallel relative to the acoustic chamber 18, as shown for example in FIG. 1, can provide more degrees-of-freedom for tuning the damping provided at one or more selected frequencies compared to damping provided by a single resonant structure. In general, acoustic resonators described herein can include any number and type of constituent resonant structures acoustically coupled with the acoustic chamber 18 and coupled with each other in series and/or in parallel relative to the acoustic chamber 18.

When plural resonant structures are coupled with an acoustic chamber in parallel relative to each other, each resonant structure is sometimes referred to in the art as a "side-branch resonator." As noted above, each respective side-branch resonator can resonate at a corresponding frequency, damping the acoustic chamber 18 at each respective frequency. And, plural side-branch resonators 13*a*, 13*b* can provide additional degrees-of-freedom for tuning the enclosure compared to a single side-branch resonator.

IV. Acoustic Resonators

In general, the acoustic resonator 11 shown in FIG. 1 can be any form of acoustic resonator. According to aspects of this disclosure, the acoustic resonator 11 refers to a plurality of side-branch resonators or other constituent resonant structures acoustically coupled with the acoustic chamber 18 in parallel relative to each other.

In turn, each constituent resonant structure in the resonator 11 can have one or more corresponding chambers or cavities configured to resonate at a respective frequency (e.g., a resonant frequency) with greater amplitude than at other frequencies. For example, a geometry of each resonant structure can be tuned to resonate at a corresponding frequency. When taken together, such a plurality of constituent side-branch resonators cause the resonator 11 to resonate at each of the respective frequencies corresponding to the tuned geometries. Accordingly, a resonator having a plurality of constituent, side-branch resonators can damp the acoustic chamber 18 at a corresponding plurality of frequencies, extending the frequency response and improving a perceptual quality of sound emitted by the enclosure 1.

Figure 3A:
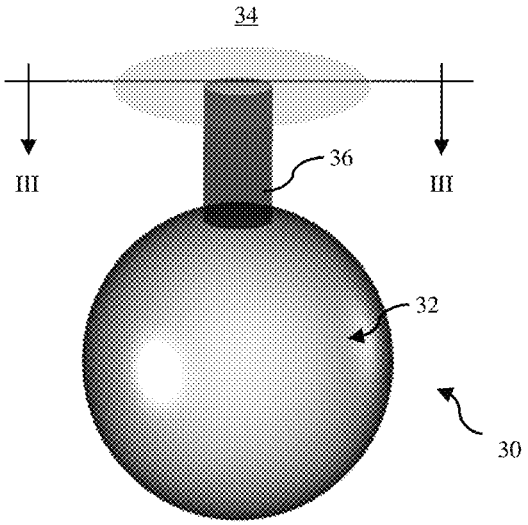
FIG. 3A schematically illustrates an isometric view of a Helmholtz resonator.
Figure 3B:
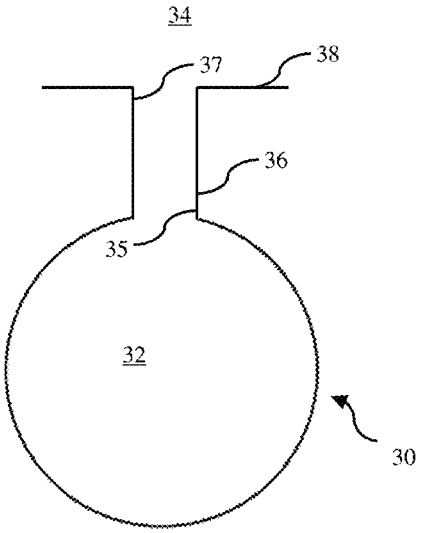
FIG. 3B schematically illustrates a cross-sectional view of the Helmholtz resonator shown in FIG. 3A along section III-III.

FIGS. 3A and 3B show an example of a chamber-based resonant structure 30, sometimes referred to in the art as a Helmholtz resonator. As shown in FIGS. 3A and 3B, a Helmholtz resonator 30 can have a closed resonant chamber 32 (or cavity) coupled to a surrounding environment 34 by way of an acoustic channel (or duct) 36. The acoustic channel 36 can extend from a proximal end 35 open to the resonant chamber 32 to a distal end 37 open to the surrounding environment 34. As well, the acoustic channel 36 can define a contraction (e.g., a smaller cross-sectional area) relative to the resonant chamber 32 and the surrounding environment 34.

A given Helmholtz resonator's resonant frequency (i.e., the frequency at which the given Helmholtz resonator resonates with a relatively larger amplitude as compared to other frequencies) corresponds the physical arrangement of the Helmholtz resonator. For example, the resonant frequency can correspond to a volume of the resonant chamber (or cavity) 32, a characteristic width (or diameter) of the acoustic channel 36 at the proximal end 35, a characteristic width (or diameter) of the acoustic channel 36 at the distal end 37, a length of the acoustic channel 36 from the proximal end 35 to the distal end 37, as well as a whether the distal end of the channel has a flange 38 or wall extending, e.g., radially outward, of the distal end 37.

Figure 4A:
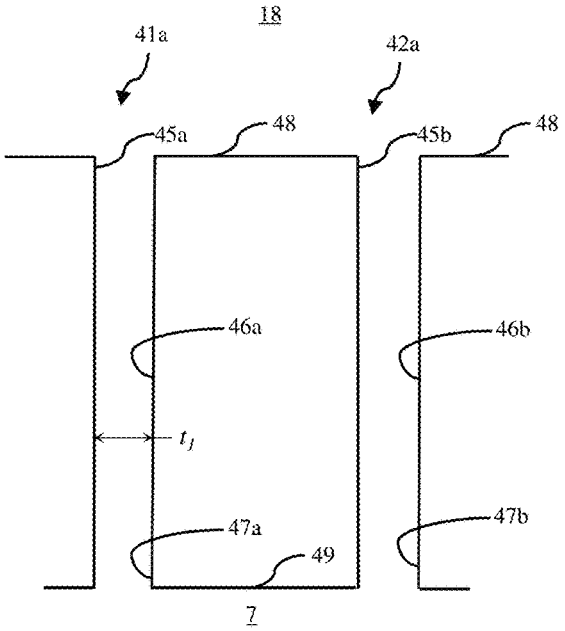
FIG. 4A illustrates a pair of open-ended side-branch resonators acoustically coupled with an acoustic enclosure in parallel relative to each other.
Figure 4B:
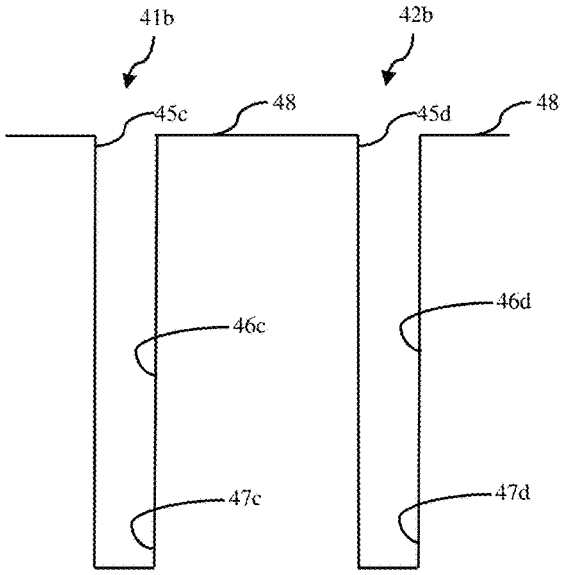
FIG. 4B illustrates a pair of closed-ended side-branch resonators acoustically coupled with an acoustic enclosure in parallel relative to each other.

Other resonant structures, e.g., shown in FIGS. 4A and 4B, can be configured as an acoustic transmission line (sometimes also referred to in the art as a "waveguide"). For example, an acoustic duct (or conduit) 46*a*, 46*b*, 46*c*, 46*d* can function as a waveguide and be tuned to damp one or more resonant frequencies in the acoustic chamber 18. These other forms of resonant structures (e.g., an open-ended or a closed-ended duct) may be substituted for or combined with a Helmholtz resonator (e.g., acoustically coupled with an acoustic chamber in series or in parallel with a Helmholtz resonator).

Referring to FIG. 4A, a pair of side-branch resonators 41*a*, 42*a* is acoustically coupled with the acoustic chamber in a parallel relative to each other. The first side-branch resonator (or waveguide) 41 has a resonant conduit 46*a* extending from a proximal end 45*a* to a distal end 47*a*. An aperture in a wall 48 of the acoustic chamber 18 defines an opening at the proximal end 45*a*, coupling the resonant conduit 46*a* with the acoustic chamber 18 (e.g., FIG. 1). An aperture at the opposed distal end 47*a* vents the conduit 46*a* to a local environment 7.

The resonant conduit 46*a* of the waveguide 41*a* spans a longitudinal length from the proximal end 45*a* to the distal end 47*a*. The illustrated waveguide 41*a* can have a circular cross-sectional shape and a substantially uniform cross-sectional dimension $t_1$, though the cross-sectional shape, the cross-sectional dimension, or both, can vary with position between the proximal end 45*a* and distal end 47*a*. For example, the dimension $t_1$ can increase with increasing distance from the proximal end and define a "horn" shape (e.g., where the cross-sectional dimension at the distal end 47*a* is comparatively larger than the cross-sectional dimension at the proximal end 45*a*). Alternatively, the dimension $t_1$ can decrease with increasing distance from the proximal end. And, the duct 46*a* need not have a circular cross-section; the cross-sectional shape can have any regular or irregular shape.

The frequencies at which the resonator 41*a* resonates (and thus the frequencies within the frequency response 22 of the enclosure 1 that the resonator 41*a* can damp) correspond to the physical arrangement of the resonator. For example, a resonant frequency for an acoustic waveguide can correspond to the cross-sectional dimension $t_1$, the cross-sectional shape, the longitudinal length of the duct 46*a* between the proximal end 45*a* and the distal end 47*a*, a contour of the duct (e.g., whether the duct expands or contracts moving longitudinally from the proximal end to the distal end), as well as whether the distal end of the channel 46*a* is open (FIG. 4A) or closed (e.g., channel 46*c* in FIG. 4B), as well as whether the distal end has a flange 49 or wall extending, e.g., radially outward, from the distal end 47*a*.

Referring still to FIG. 4A, a second side-branch resonator 42*a* is illustrated. The illustrated resonant structure 42*a* is shown as an open-ended waveguide having a physical configuration similar to the first side-branch resonator 41*a* just described. For example, the second waveguide 42*a* has a resonant conduit 46*b* extending from a proximal end 45*b* to a distal end 47*b*. A second aperture in the wall 48 defines an opening at the proximal end 45*b*, coupling the resonant conduit 46*b* with the acoustic chamber 18 (FIG. 1) in parallel relative to the first waveguide 41*a*. An aperture at the opposed distal end 47*b* vents the conduit 46*b* to the local environment 7. As with the resonator 41*a*, the resonator 42*a* can have a uniform or a non-uniform cross-sectional shape or dimension.

Referring still to FIG. 4A, each aspect of one side-branch resonator 41*a* can be identical to or different from the corresponding aspect of an adjacent side-branch resonator 42*a*. Or, certain aspects of one resonator 41*a* can be identical to the corresponding aspects of the other resonator 42*a*, while other aspects of can differ between the resonators. As but one example, both ducts 46*a*, 46*b* can have identical cross-sectional shapes and dimensions, but one duct 46*a* can be shorter or longer than the other duct 46*b*.

As a consequence, the resonant frequency of each respective side-branch resonator 41*a*, 42*a* may differ from that of the other resonator, damping the frequency response of the acoustic chamber 18 at each of the resonant frequencies. By damping the frequency response of the acoustic chamber at a plurality of resonant frequencies, a plurality of peaks in the frequency response 22 can be flattened, reducing the computational overhead needed to equalize audio playback and physically extending the frequency response of the acoustic chamber.

As noted, the waveguides 41*a*, 42*a* (FIG. 4A) have open-ended ducts 46*a*, 46*b*. By contrast, the side-branch resonators 41*b*, 42*b* (FIG. 4B), which are similar in form to the waveguides 41*a*, 42*a*, have closed-ended ducts 46*c*, 46*d*. The closed ends of the ducts 46*c*, 46*d* cause the waveguides 41*b*, 42*b* to resonate at a different frequency than the waveguides 41*a*, 42*a* having open-ended ducts 46*a*, 46*b* when all other aspects (e.g. dimensions) of the waveguides are identical. For example, even if the waveguides 41*a*, 42*a* have identical lengths and cross-sectional dimensions, shapes and contours, as the waveguides 41*b*, 42*b*, the waveguides 41*a*, 42*a* will resonate at a different frequency than the waveguides 41*b*, 42*b* simply by virtue of the difference in their end configurations.

Figure 4C:
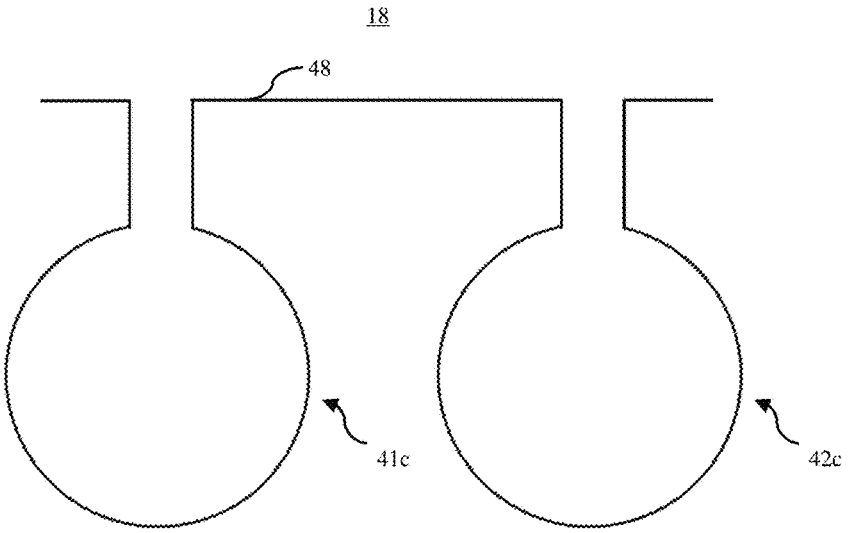
FIG. 4C illustrates a pair of Helmholtz resonators acoustically coupled with an acoustic enclosure in parallel relative to each other.

Referring now to FIG. 4C, a pair of Helmholtz resonators 41*c*, 42*c* is shown. Each Helmholtz resonator 41*c*, 42*c* is configured generally as described above in connection with FIGS. 3A and 3B, though specific aspects (e.g., chamber volume, duct length, etc.) may differ between the resonators 41*c*, 42*c*. Such differences can cause each resonator 41*c*, 42*c* to resonate at a respective frequency, and when combined as depicted in FIG. 4C, to damp the frequency response 22 of the acoustic chamber 18 at the respective frequencies.

Aspects of similarity or dissimilarity between side-branch resonators acoustically coupled to the chamber 18 can include dimensional characteristics (e.g., length of the ducts 46*a*, 46*b*, cross-sectional dimension or shape, etc.). And, aspects of similarity or dissimilarity can include overall configuration of the waveguides themselves. For example, one side-branch resonator coupled with the acoustic chamber 18 may be an open-ended waveguide as described in connection with FIG. 4A, another side-branch resonator coupled with the acoustic chamber 18 may be a Helmholtz resonator as described in connection with FIGS. 3A and 3B, and yet another side-branch resonator coupled with the acoustic chamber 18 may be a closed-ended waveguide as described in connection with FIG. 4B. For example, the side-branch resonator 42*a* shown in FIG. 4A can be replaced with a closed-ended side-branch resonator 41*b* or 42*b* shown in FIG. 4B. Alternatively, a Helmholtz resonator can replace the side-branch resonator 42*a* shown in FIG. 4A. As yet another alternative, a Helmholtz resonator can replace the side-branch resonator 42*b* shown in FIG. 4B. Thus, a pair of side-branch resonators can consist of any of the following combinations: two open-ended waveguides (FIG. 4A), two closed-ended waveguides (FIG. 4B), two Helmholtz resonators (FIG. 4C), one open-ended waveguide and one closed-ended waveguide, one open-ended waveguide and one Helmholtz resonator, or one closed-ended waveguide and one Helmholtz resonator.

As well, it should be understood that more than two side-branch resonators can be incorporated in a loudspeaker enclosure to provide tunable damping across a plurality of peaks in a frequency response (e.g., frequency response 22). By coupling a plurality of distinct side-branch resonators with an acoustic chamber (e.g., in series or in parallel relative to one of more other side-branch resonators), dimensions (and thus damping frequency) of each side-branch resonator can be adjusted with little or no effect on frequency-damping provided by another side-branch resonator. As a consequence, a plurality of resonant peaks in the frequency response of an acoustic enclosure can be selectively damped by such a plurality of side-branch resonators acoustically coupled with the enclosure.

In FIGS. 4A, 4B, and 4C, each pair of constituent resonant structures 41*a*, 42*a*; 41*b*, 42*b*; and 41*c*, 42*c* is acoustically coupled with the acoustic chamber 18 in parallel relative to each other. Further, the resonant structures are physically juxtaposed relative to each other. Nonetheless, one constituent resonant structure may be partially or wholly positioned within another constituent resonant structure.

Figure 5A:
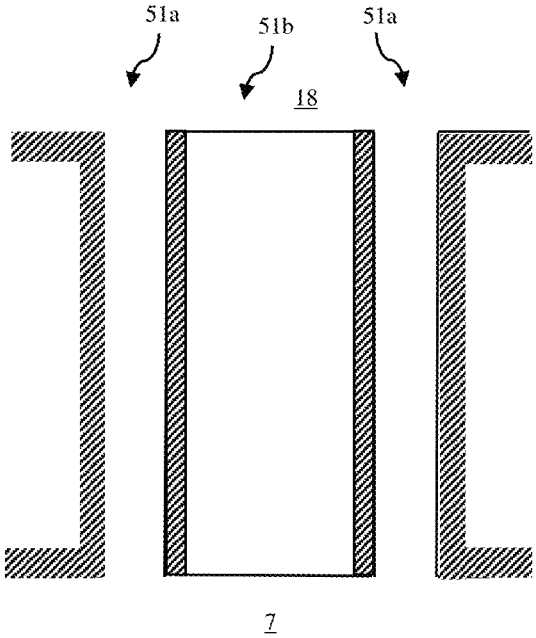
FIG. 5A illustrates another pair of open-ended side-branch resonators acoustically coupled with an acoustic enclosure in parallel relative to each other.

For example, FIG. 5A shows a first side-branch resonator 51*a* at least partially surrounding a second side-branch resonator 52*a*. In FIG. 5A, the side-branch resonators 51*a*, 52*a* are acoustically coupled with an acoustic chamber 18 in parallel relative to each other. Each of the side-branch resonators 51*a*, 52*a* also is open to an external environment 7 and configured as an open-ended waveguide. As indicated by FIG. 5A, the resonator 51*a* can have an annular cross-sectional shape surrounding the resonator 51*b*. Similarly, the resonator 51*b* can have a circular cross-sectional shape. Of course, the cross-sectional shapes need not be annular and circular, respectively. Rather, each resonator can have any selected regular or irregular cross-sectional shape that allows the external resonator 51*a* to extend around a perimeter of the inner resonator 52*a*, or vice-versa. Similarly, one or both of the resonators 51*a*, 51*b* can have a closed terminal end, rather than an open terminal end as illustrated in FIG. 5A.

Figure 5B:
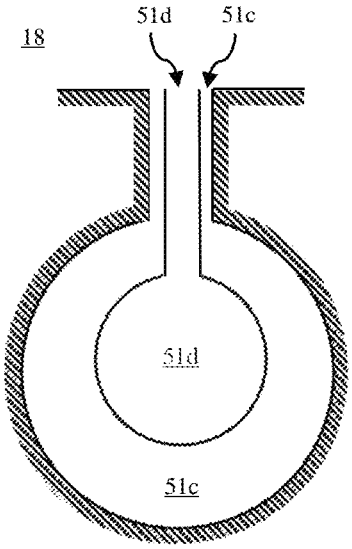
FIG. 5B illustrates another pair of side-branch Helmholtz resonators acoustically coupled with an acoustic enclosure in parallel relative to each other.

FIG. 5B illustrates another example of a side-branch resonator 51*c* surrounding another side-branch resonator 51*d*. In FIG. 5B, each side-branch resonator 51*c*, 51*d* is arranged as a Helmholtz resonator (e.g., having a neck region and an enlarged, terminal chamber). Although not illustrated, a Helmholtz resonator can surround or enclose an open-ended or a closed-ended waveguide in a manner shown in FIGS. 5A and 5B. Similarly, an open-ended or a closed-ended waveguide can surround or enclose a Helmholtz resonator in a manner shown in FIGS. 5A and 5B.

IV. Damped Enclosures

Figure 6:
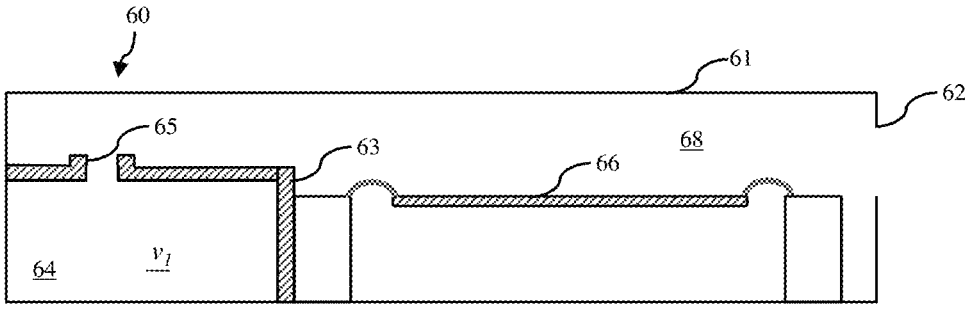
FIG. 6 schematically illustrates aspects of an acoustic enclosure incorporating one or more side-branch resonators.

FIG. 6 shows a schematic, cross-sectional view of a loudspeaker enclosure 60 having a housing 61 and a port 62 opening from an acoustic chamber 68. As with the enclosure 1 in FIG. 1, the enclosure 60 includes a loudspeaker diaphragm 66 to emit sound and a side-branch resonator 63 acoustically coupled with the acoustic chamber 68. The arrangement of the resonator 63 damps one or more selected frequencies within the chamber 68. In FIG. 6, the resonator 63 is arranged as a Helmholtz resonator having a neck 65 that opens to a resonant chamber 64 with volume, VI.

Figure 7:
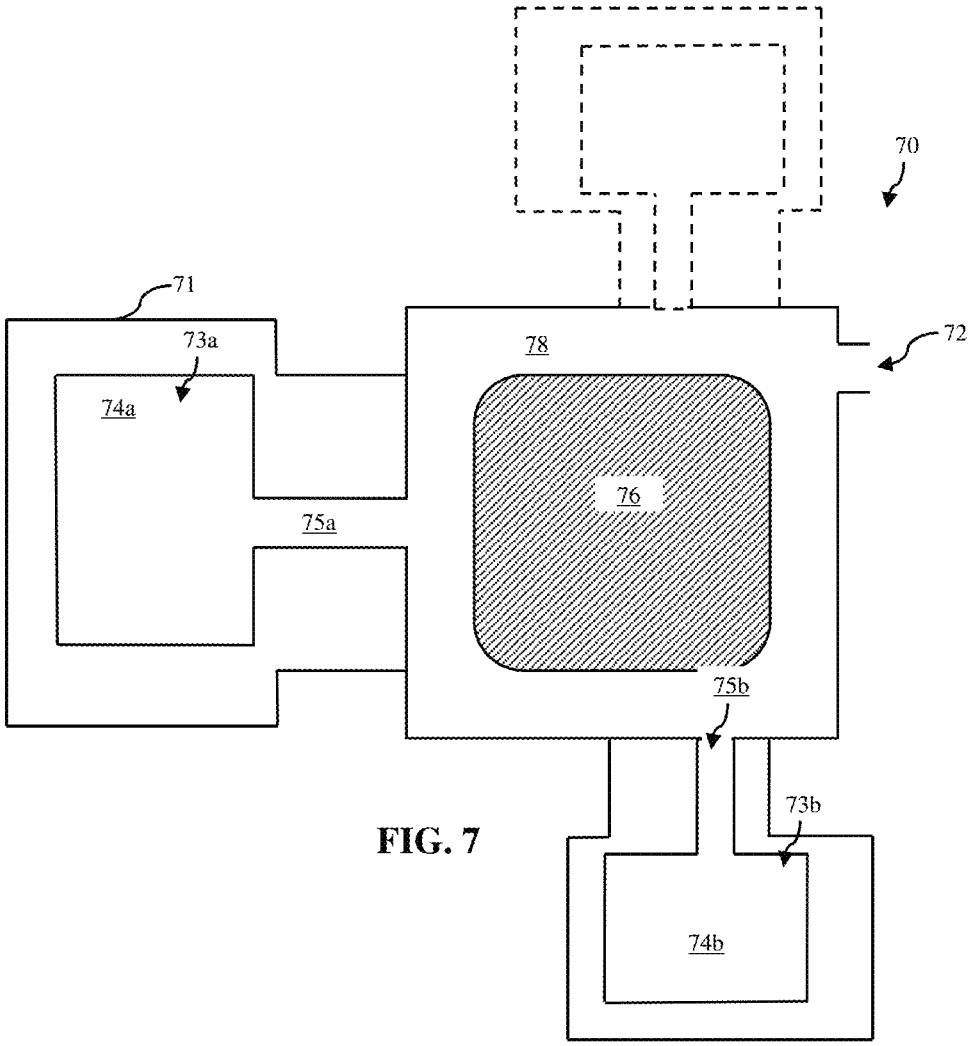
FIG. 7 schematically illustrates a plan-view from above showing aspects of an acoustic enclosure incorporating one or more side-branch resonators.

FIG. 7 illustrates a top-plan view of a loudspeaker enclosure 70 similar to the enclosure 60. The enclosure 70 has a housing 71 and a port 72 opening to a local environment from an acoustic chamber 78. A diaphragm 76 emits sound within the chamber 78. A first side-branch resonator 73*a* is acoustically coupled with the acoustic chamber 78 in parallel relative to a second side-branch resonator 73*b*. In FIG. 7, each side-branch resonator 73*a*, 73*b* is configured as a Helmholtz resonator having a corresponding neck 75*a*, 75*b* that opens to a corresponding resonant chamber 74*a*, 74*b* from the acoustic chamber 78.

Each side-branch resonator can be configured to resonate at a selected frequency, allowing each side-branch resonator to damp a frequency response of the acoustic chamber 78 at a corresponding frequency. For example, the first resonator 73*a* can resonate at a first frequency and the second resonator 73*b* can resonate at a second frequency. By acoustically coupling the first and the second side-branch resonators 73*a*, 73*b* with the acoustic chamber 78 in parallel relative to each other, the frequency response of the acoustic chamber 78 can be damped at the first frequency and the second frequency, extending a frequency response of the acoustic chamber 78 generally as described above in relation to FIG. 2.

In FIG. 7, an optional side-branch resonator is depicted using dashed lines. The optional side-branch resonator illustrates that more than two side-branch resonators may be acoustically coupled with the acoustic chamber 78 in parallel relative to each other. The inclusion of a selected number of side-branch resonators permits damping a corresponding number of frequencies in the frequency response of the acoustic chamber 78, and can provide a suitable number of degrees-of-freedom to system designers.

Figure 8:
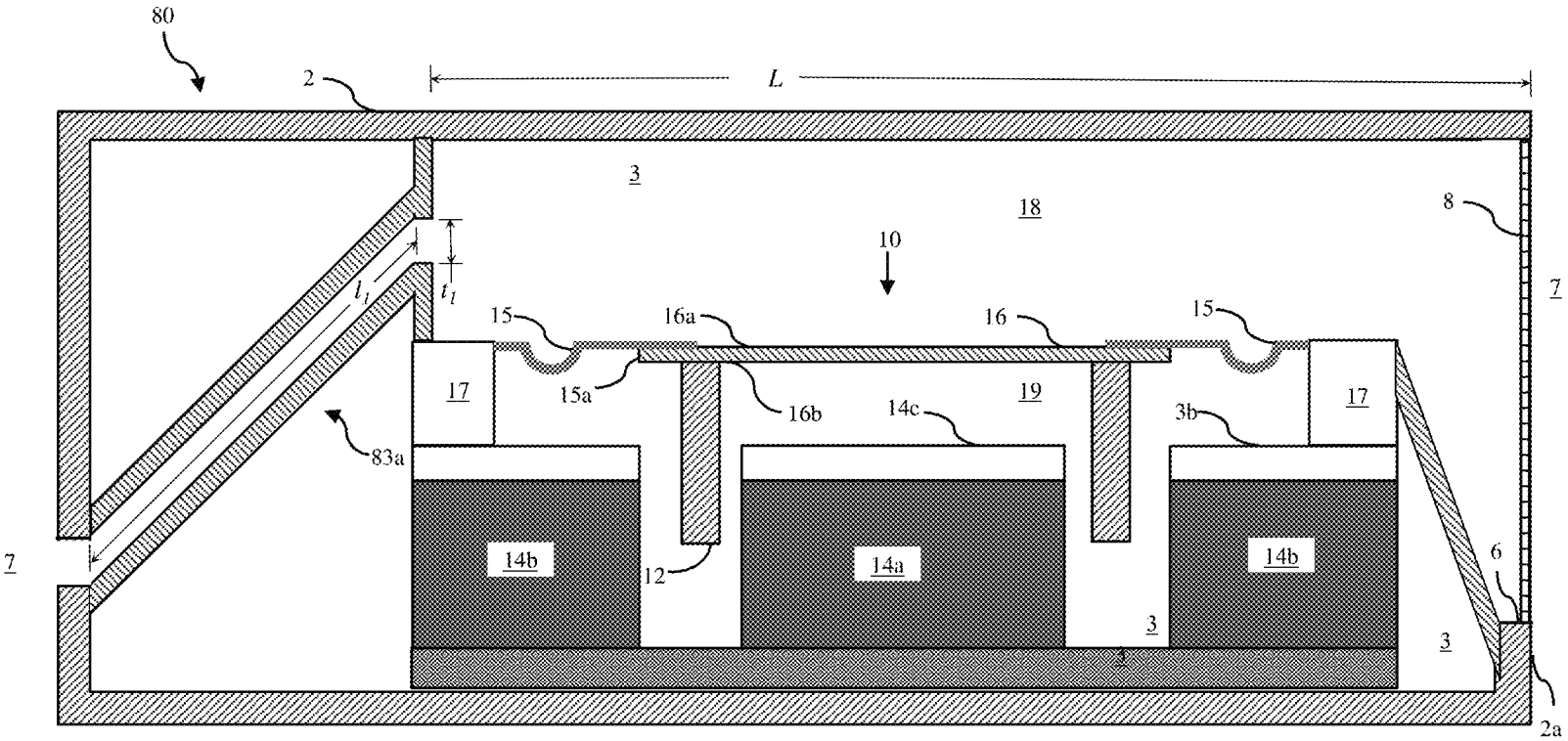
FIG. 8 illustrates a cross-sectional view of another damped acoustic enclosure and loudspeaker transducer.
Figure 9:
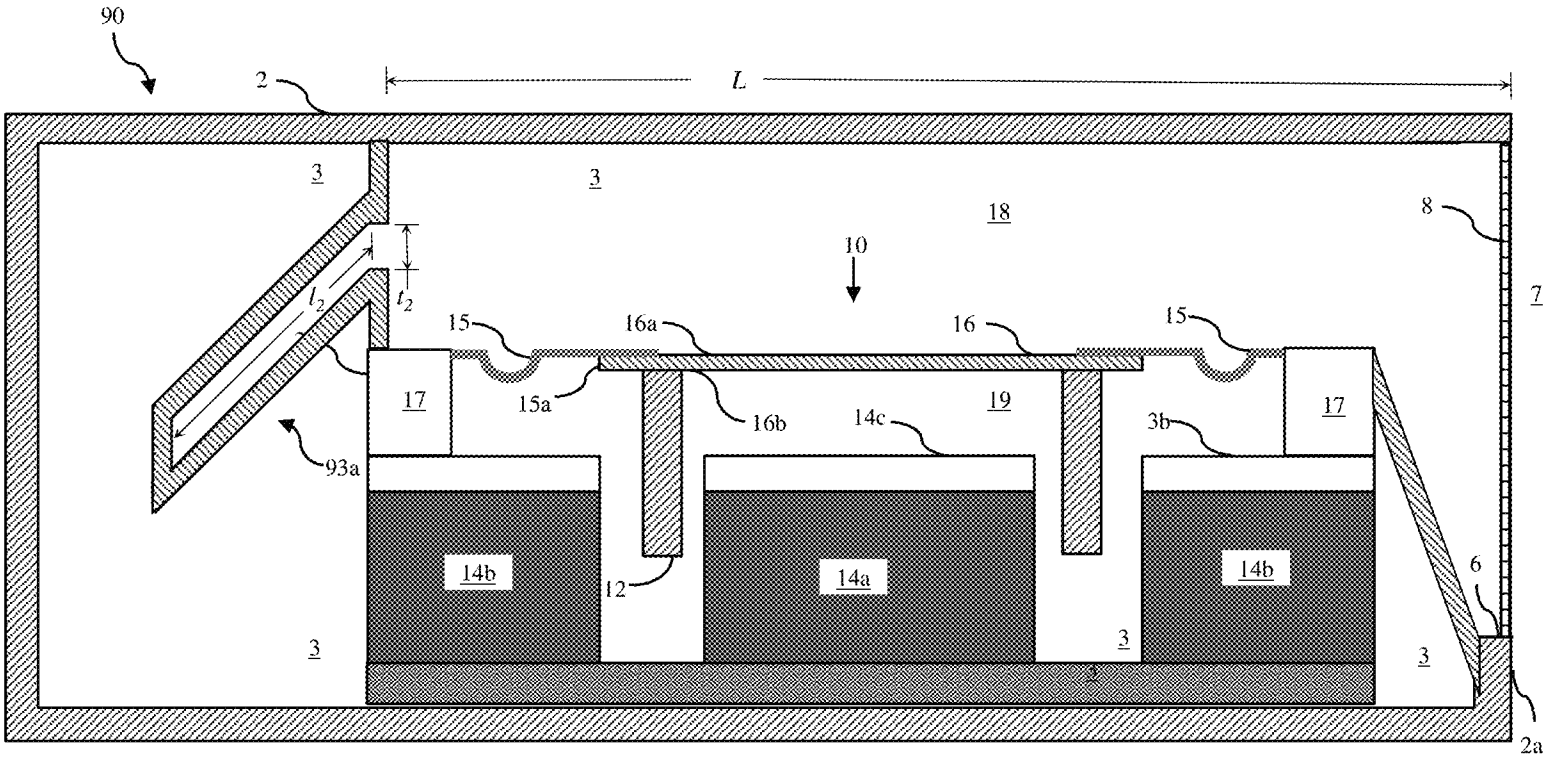
FIG. 9 illustrates a cross-sectional view of another damped acoustic enclosure and loudspeaker transducer.

FIGS. 8 and 9 illustrate respective side-views of a cross-section through a loudspeaker enclosure generally as in FIG. 1. The loudspeaker enclosure 80 is similar to the enclosure 1 in FIG. 1 in most respects, except that the combined resonator 11 (consisting of the constituent side-branch resonators 13*a*, 13*b*) is omitted. Instead, an open-ended waveguide 83*a* is shown in FIG. 8. The open-ended waveguide 83*a* has a duct length $I_1$ extending from a proximal end opening to the acoustic chamber 18 to a distal end opening to a local environment 7 surrounding the enclosure 80, damping a frequency response of the acoustic chamber 18 at a corresponding frequency. The waveguide 83*a* has a cross-sectional dimension $t_1$.

The enclosure 90 shown in FIG. 9 is similar in most respects to the enclosure 80 shown in FIG. 8, except that the open-ended waveguide 83*a* has been removed and replaced with a closed-ended waveguide 93*a*. The closed-ended waveguide 93*a* remains a side-branch resonator acoustically coupled with the acoustic chamber 18, as with the waveguide 83*a*. The closed-ended waveguide 93*a* has a duct length $I_2$ extending from a proximal end opening to the acoustic chamber 18 to a closed distal end, damping a frequency response of the acoustic chamber 18 at a corresponding frequency. The waveguide 93*a* has a cross-sectional dimension $t_2$.

One or more additional side-branch resonators also are positioned outside the planes depicted in FIGS. 8 and 9, and thus are not shown in those drawings. Nonetheless, one or more additional side-branch resonators are included in the enclosure 80 and the enclosure 90, generally as described above, e.g., in connection with FIGS. 6 and 7. Each additional side-branch resonator damps a frequency response of the respective enclosure 80, 90 at each of one or more corresponding additional frequencies.

Figure 10:
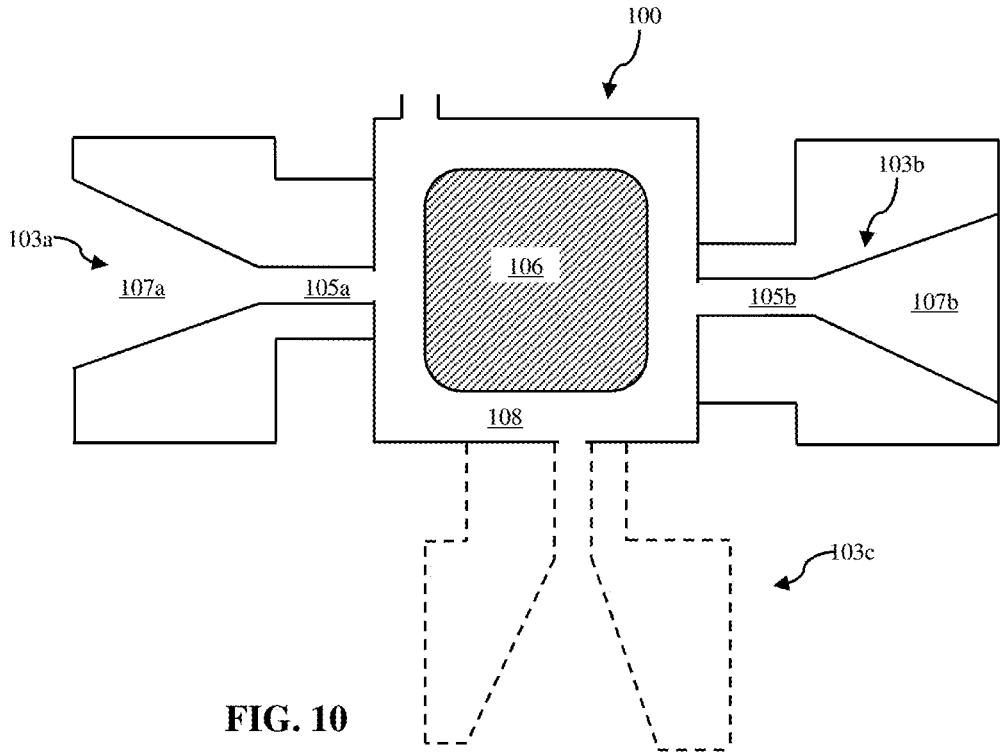
FIG. 10 schematically illustrates a plan-view from above showing aspects of an acoustic enclosure incorporating a plurality of side-branch resonators.

FIG. 10 shows a top plan view of another enclosure 100. The enclosure 100 is arranged similarly to the enclosure shown in FIG. 7 and has a plurality of side-branch resonators 103*a*, 103*b* acoustically coupled with the acoustic chamber 108 in parallel relative to each other. However, rather than extending from adjacent walls of the acoustic chamber as in FIG. 7, the side-branch resonators 103*a*, 103*b* extend from opposed walls of the acoustic chamber, with the diaphragm 106 positioned therebetween. A loudspeaker diaphragm 106 emits sound into the chamber 108, and a respective frequency resonates within each respective side-branch resonator 103*a*, 103*b*, damping a frequency response of the acoustic chamber 108 at corresponding frequencies.

In FIG. 10, the first side-branch resonator 103*a* has a first region 105*a* and a second region 107*a*. The first region 105*a* has a smaller cross-sectional dimension than the second region 107*a*, which has a cross-sectional area that expands from a region adjoining the first region 105*a* to an opposed terminal end. The terminal end of the resonator 103*a* is open to a local environment. The second side-branch resonator 103*b* is similar to the first side-branch resonator 103*a*, except that the terminal end of the second region 107*b* is closed. As with the resonator 103*a*, the first region 105*b* of the second resonator 103*b* extends from the acoustic chamber 108 to the second region 107*b*, and the second region 107*b* has a cross-sectional area that expands from a region adjoining the first region 105*b* to the closed terminal end. Also shown in FIG. 10 using dashed lines is another, optional, side-branch resonator 103*c*. As with the enclosure 70 shown in FIG. 7, any of the side-branch resonators shown in FIG. 10 can be replaced with a Helmholtz-style resonator (e.g., FIGS. 3A and 3B) or a differently configured waveguide.

V. In-Ear Earphones

An acoustic enclosure incorporating one or more side-branch resonators can be incorporated in any of a variety of devices, including portable media devices and accessories used with media devices. For example, in-ear earphones can incorporate one or more side-branch resonators as described herein.

Figure 11:
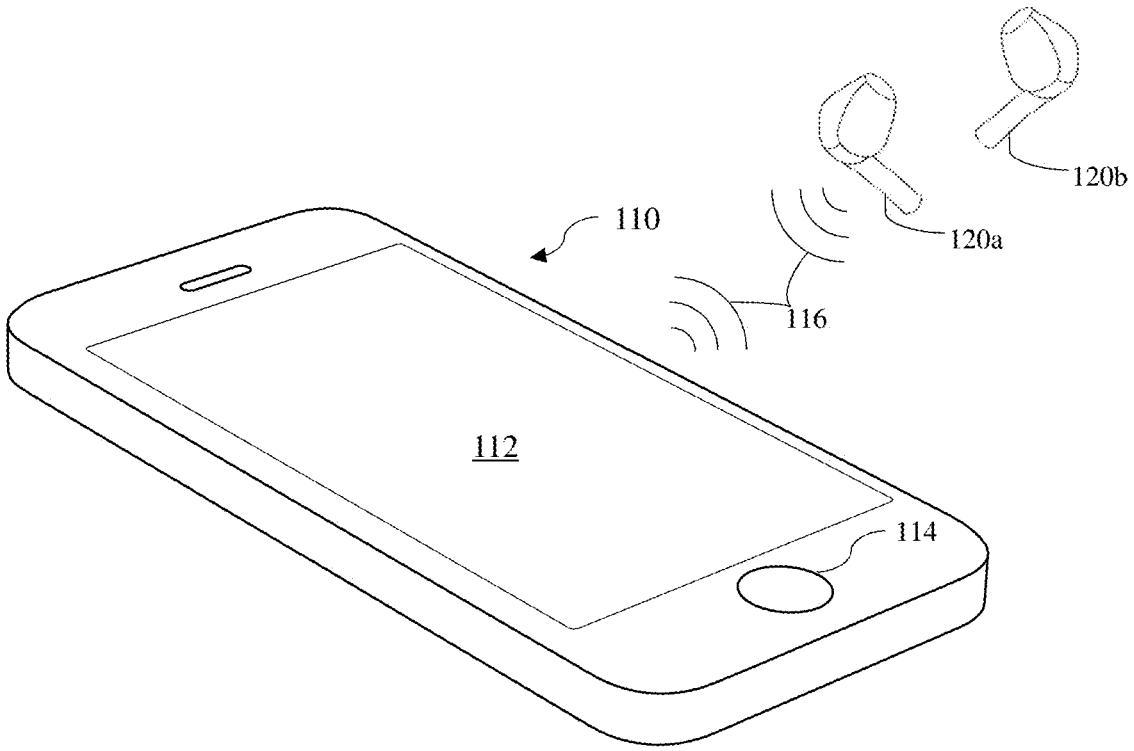
FIG. 11 illustrates a media device and an associated audio accessory.

FIG. 11 shows a portable media device 110 suitable for use with a variety of accessory devices. The portable media device 110 can include a touch sensitive display 112 configured to provide a touch sensitive user interface for controlling the portable media device 110 and in some embodiments any accessories to which the portable media device 110 is electrically or wirelessly coupled. For example, the media device 110 can include a mechanical button 114, a tactile/haptic button, or variations thereof, or any other suitable ways for navigating on the device. The portable media device 110 can also include a communication connection, e.g., one or more hard-wired input/output (I/O) ports that can include a digital I/O port and/or an analog I/O port, or a wireless communication connection. The portable media device can include a damped acoustic enclosure arranged as described above.

An accessory device can take the form of, for example, an audio device that includes two separate earbuds 120*a* and 120*b* (also referred to in the art as "in-ear earphones" or, more specifically, "intra-canal earphones" or "intra-concha earphones"). Each of the earbuds 120*a* and 120*b* can include wireless receivers, transmitters or transceivers capable of establishing a wireless link 116 with the portable media device 110 and/or with each other. Alternatively, and not shown in FIG. 11, the accessory device can take the form of a wired or tethered audio device that includes separate earbuds. Such wired earbuds can be electrically coupled to each other and/or to a connector plug by a number of wires. The connector plug can matingly engage with one or more of the I/O ports and establish a communication link over the wire and between the media device and the accessory. In some wired embodiments, power and/or selected communications can be carried by the one or more wires and selected communications can be carried wirelessly.

Intra-concha earphones typically fit in the outer ear and rest just above the inner ear canal. Intra-concha earphones do not typically seal within the ear canal. Sound quality, however, may not be optimal to the user because sound can leak from the ear-phone and not reach the ear canal. In addition, due to the differences in ear shapes and sizes among users, different amounts of sound may leak thus resulting in inconsistent acoustic performance between or among users.

Figure 15:
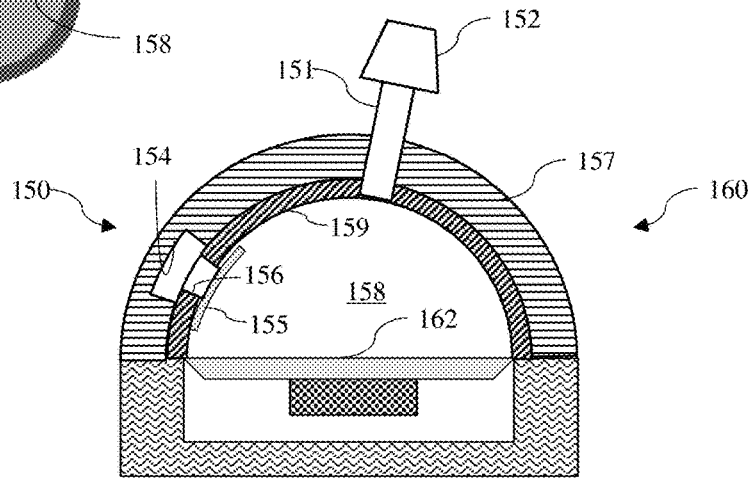
FIG. 15 illustrates an exploded, isometric view of a housing for an in-ear earphone.
Figure 16:
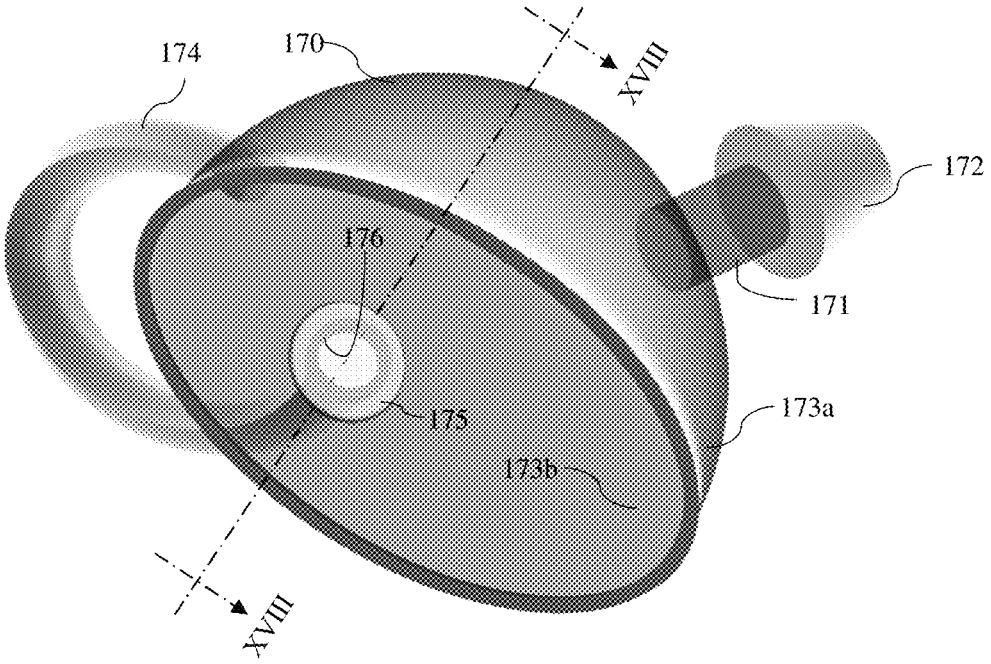
FIG. 16 illustrates a cross-sectional view of the housing shown in FIG. 15 taken along section line XVI-XVI when assembled with a loudspeaker transducer.

Referring now to FIGS. 15 and 16, intra-canal earphones, on the other hand, are typically designed to fit within and form a seal with the user's ear canal. Intra-canal earphones therefore have an acoustic output tube portion that extends from the housing. The open end of the output tube portion can be inserted into the wearer's ear canal. The tube portion typically forms, or is fitted with, a flexible and resilient tip or cap made of a rubber or silicone material. The tip may be custom molded for the discerning audiophile, or it may be a high-volume manufactured piece. When the tip portion is inserted into the user's ear, the tip compresses against the ear canal wall and creates a sealed (essentially airtight) cavity inside the canal. Although the sealed cavity allows for maximum sound output power into the ear canal, it can amplify external vibrations, thus diminishing overall sound quality.

Figure 12:
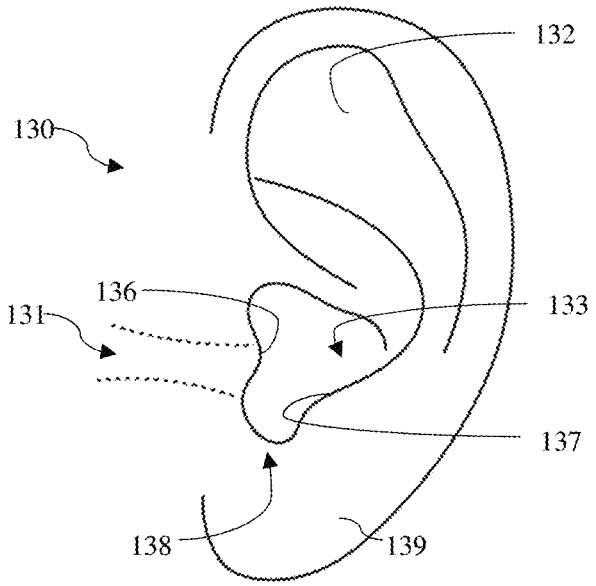
FIG. 12 illustrates an external, isometric view of a housing for an in-ear earphone.
Figure 13:
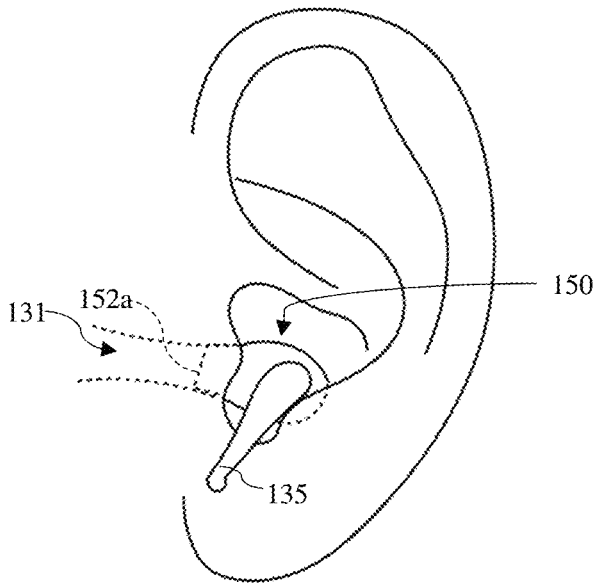
FIG. 13 schematically illustrates anatomy of a typical human ear.

FIG. 12 schematically illustrates common anatomy 130 of a human ear. FIG. 13 shows an earbud positioned within an ear 130 of a user during use. For example, when properly positioned in a user's ear 130, the earphone housing 150 (FIGS. 14 and 15) can rest in the user's concha cavum 133 between the user's tragus 136 and anti-tragus 137. As shown in FIG. 13, a portion of the housing 150 can extend into the ear canal 131. Those of ordinary skill in the art will understand and appreciate that, although a housing 150 is described in relation to the concha cavum 133, other external regions of an earphone can be contoured relative to another region of a human ear 130. For example, other ear-contact regions are possible.

The housing 150 illustrated in FIG. 13 also defines a lateral surface from which a post 135 extends. The post 135 can include a microphone transducer and/or other component(s) such as, for example, a battery or, in context of a wired earbud, one or more wires. Additionally, or alternatively, the post can incorporate one or more side-branch resonators acoustically coupled with an acoustic chamber in the housing 150, damping the acoustic chamber in a manner as described herein. When the earbud is donned, as in FIG. 13, the post 135 can extend generally parallel to a plane defined by the user's earlobe 139 at a position laterally outward of a gap 138 between the user's tragus 136 and anti-tragus 137.

Further, the earbud housing 150 defines an acoustic port 152*a*. The port 152*a* provides an acoustic pathway from an acoustic chamber 158 (FIG. 14) in an interior region of the housing 150 to an exterior of the housing. For example, as shown in FIG. 13, the port 152*a* aligns with and opens to the user's ear canal 131 when the earbud is donned as described above. A mesh, screen, film, or other protective barrier (not shown) can extend across the port 152*a* to inhibit or prevent intrusion of debris into the interior of the housing.

Figure 14:
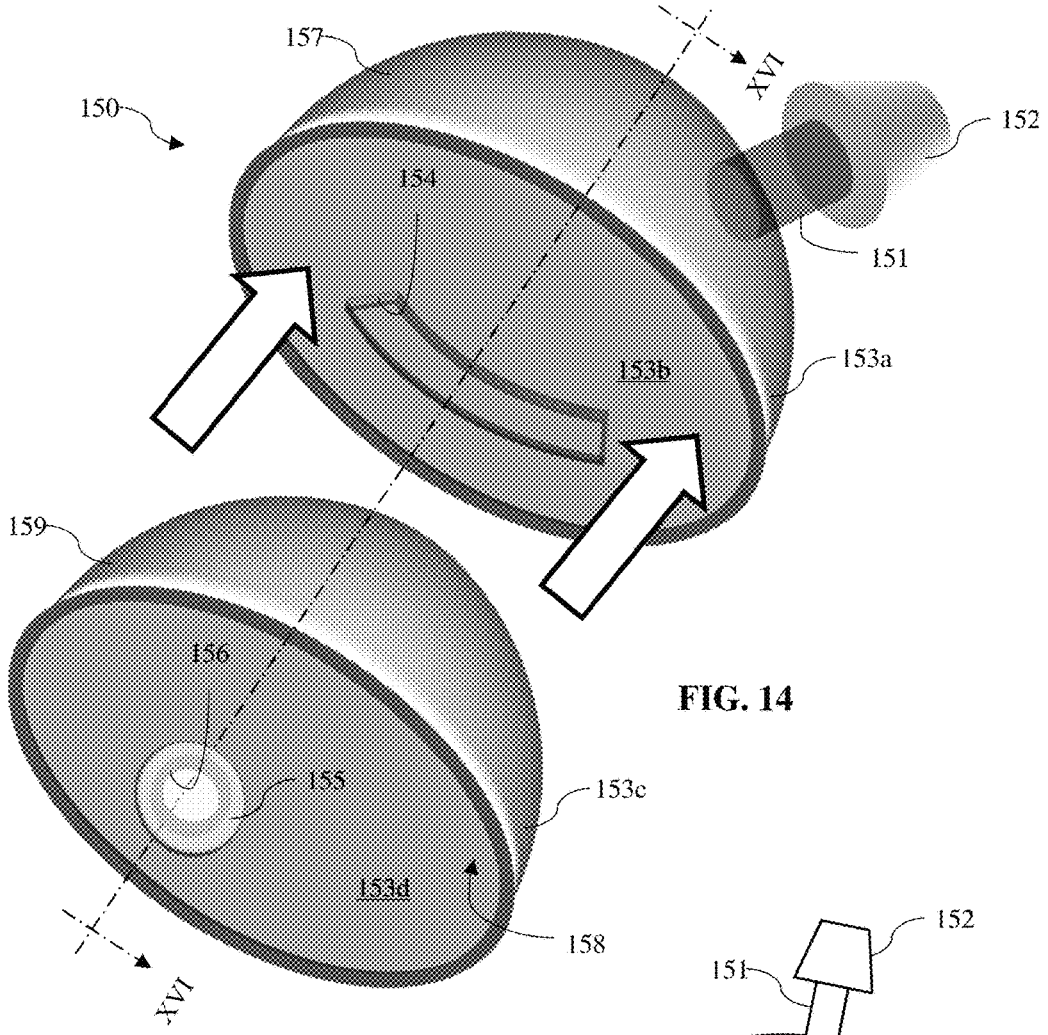
FIG. 14 schematically illustrates an in-ear earphone positioned in the human ear shown in FIG. 13.

As shown in FIGS. 14 and 15, some earbud the housings 150 define a boss or other protrusion 151 from which the port 152*a* opens. The boss or other protrusion 151 can extend into the ear canal 131 (FIG. 13) and can contact the walls of the canal over a contact region. Alternatively, referring again to FIG. 15, the boss or other protrusion 151 can provide a structure to which a resiliently flexible cover 152 such as, for example, a silicone cover, can attach and provide an intermediate structure forming a sealing engagement between the walls of the user's ear canal 131 and the housing 150. The sealing engagement can enhance perceived sound quality, as by passively attenuating external noise and inhibiting a loss of sound power from the earbud.

Referring still to FIGS. 14 and 15, an earbud housing 150 incorporating one or more side-branch resonators is shown. The illustrated housing 150 is a two-piece housing having an outer housing member 157 and an inner housing member 159. The outer housing member 157 matingly receives the inner housing member 159. The outer housing member 157 and the inner housing member 159 are so complementarily configured relative to each other as to define one or more constituent resonators of the type described above to damp an acoustic chamber 158 defined at least in part by an interior region of the inner housing member 159.

For example, the illustrated outer housing member 157 is a shell having a convex outer surface 153*a* and a concave inner surface 153*b*. The inner surface 153*b* defines a recessed groove 154. The illustrated inner housing member 159 also is a shell having a convex outer surface 153*c* and a concave inner surface 153*d*. The inner housing member 159 also defines an aperture 156 extending through the shell from the inner surface 153*d* to the outer surface 153*c*.

FIG. 15 shows a cross-sectional view of an acoustic enclosure 160 incorporating an earbud housing 150. As shown in FIG. 15, the aperture 156 can be so positioned relative to the inner housing member 159 as to overlie and acoustically couple with the recessed groove 154 defined by the outer housing member 157, e.g., when the inner shell is seated against the convex inner surface 153*b* of the outer shell. The aperture 156 defines an acoustic port acoustically coupling the inner region 158 of the convex inner surface 153*d* with the recessed groove 154 defined by the outer shell.

When the inner shell 159 and the outer shell 157 are assembled together as shown in FIG. 15, the port 156 and the groove 154 together define a side-branch resonator acoustically coupled with the acoustic chamber 158, damping the frequency response of the enclosure 160 when driven by the diaphragm 162. According to selected dimensions and contours of the groove 154 and the aperture 156, such a side-branch resonator may exhibit resonance characteristic predominantly similar to a Helmholtz resonator, predominantly similar to a waveguide, or similar to a combination of a Helmholtz resonator and a waveguide.

To facilitate tuning of the side-branch resonator, an acoustic mesh 155 can be positioned to overlie the port 156. Optionally, one or more additional side-branch resonators can be incorporated in the enclosure 160 (or in an earbud stem as described above). And, as shown in FIG. 15, the inner housing member 159 can define another aperture (not shown) to acoustically couple the acoustic chamber 158 with an outlet port 152*a*, e.g., to a wearer's ear canal, defined by the outer housing member 157. And, although only one groove 154 and one port 156 are depicted in FIG. 15 for sake of clarity, it shall be understood that additional side-branch resonators formed from groove-and-port combinations can be defined by the housings 157, 159. Moreover, the groove 154 need not be defined by the outer housing 157. Rather, the convex outer surface of the inner shell 159 can define a recessed groove extending from the aperture 156, and a corresponding region of the inner surface 153*b* can overlie the groove, defining a side-branch resonator.

Figure 17:
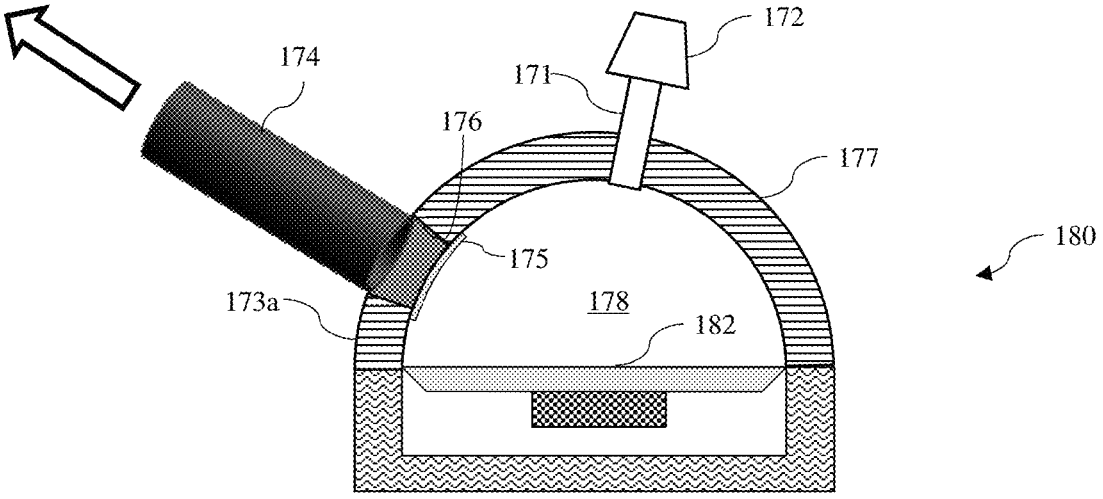
FIG. 17 illustrates an isometric view of another housing for an in-ear earphone.

As shown in FIGS. 16 and 17, a side-branch resonator may extend outward of an earbud housing. For example, the housing 170 is a shell similar in construction to the outer shell 157 insofar as it defines an outlet port extending through a protrusion 171 and the protrusion 171 has a compliant member 172 to sealingly engage a wearer's ear canal. However, unlike the outer shell 157, the housing 170 also defines an aperture 176 extending from an inner surface 173*b* to an outer surface 173*a*.

As best illustrated in the cross-sectional view of the acoustic enclosure 180 in FIG. 17, an acoustic duct 174 extends from the aperture 176 outward of the outer surface 173*a*, defining a side-branch resonator acoustically coupled with the acoustic chamber 178 (FIG. 17). More particularly, the illustrated acoustic duct 174 defines a waveguide to acoustically damp an acoustic response of the acoustic chamber 178 when driven by the diaphragm 182. Nonetheless, the duct 174 can be contoured differently so as to define a Helmholtz resonator (rather than a waveguide) in combination with the port 176.

Referring again to FIG. 16, the duct 174 can have an open or a closed terminal end, defining, respectively, an open-ended or a closed-ended waveguide. As well, the acoustic duct 174 can define a longitudinal curve (e.g., it can be "bent") to further define a concha- or a pinna-engaging member that urges against a wearer's concha 133 or pinna 132 (FIG. 12), respectively, when the enclosure 180 is donned by a wearer.

To enhance a wearer's comfort, a concha-engaging region of the duct 174 can incorporate a compliant member (not shown). As well, such a compliant member can conform to person-to-person variations in contour among the tragus 136, anti-tragus 137, and concha cavum 133. Such a compliant member (not shown) can accommodate a selected degree of compression that allows secure seating of enclosure 180 within the ear 130 of the user, e.g., within the concha cavum 133. Although not illustrated, the enclosure 180 can incorporate one or more additional side-branch resonators as described herein.

Further, the enclosure 180 can include an externally-extending side-branch resonator similar to the resonator 174. In that instance, the inner shell 159 and the outer shell 157 define respective apertures extending through the respective shells and positioned in alignment with each other to acoustically couple the duct of the side-branch resonator 174 with the acoustic chamber 158.

The housing of any acoustic enclosure described herein can be formed of any material or combination of materials suitable for acoustic enclosures. For example, some housings are formed of acrylonitrile butadiene styrene (ABS). Other representative materials include polycarbonates, acrylics, methacrylates, epoxies, and the like. A compliant member described herein can be formed of, for example, polymers of silicone, latex, and the like.

VI. Electronic Devices with Damped Acoustic Chambers

Electronic devices, including those having damped acoustic chambers of the type described above, are described by way of reference to a specific example of an audio appliance. Electronic devices represent but one possible class of computing environments which can incorporate an acoustic enclosure, and more particularly, a damped acoustic chamber, as described herein. Nonetheless, electronic devices, including the portable media device 110 (FIG. 11) are succinctly described in relation to a particular audio appliance 190 to illustrate an example of a system incorporating and benefitting from a damped acoustic chamber.

Figure 18:
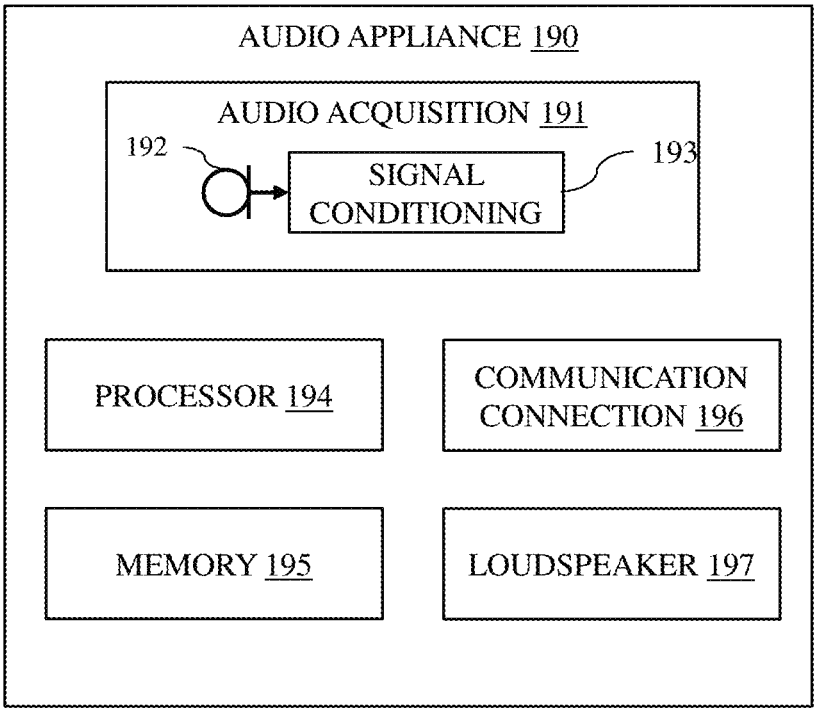
FIG. 18 illustrates a cross-sectional view of the housing shown in FIG. 17 taken along section line XVIII-XVIII assembled with a loudspeaker transducer.

As shown in FIG. 18, an audio appliance 190 or other electronic device can include, in its most basic form, a processor 194, a memory 195, and a loudspeaker or other electro-acoustic transducer 197, and associated circuitry (e.g., a signal bus, which is omitted from FIG. 19 for clarity). The memory 195 can store instructions that, when executed by the processor 194, cause the circuitry in the audio appliance 190 to drive the electro-acoustic transducer 197 to emit sound over a selected frequency bandwidth.

In addition, the audio appliance 190 can have a ported acoustic chamber positioned adjacent the electro-acoustic transducer, together with an acoustic resonator acoustically coupled with the acoustic chamber. As described above, the acoustic resonator can include a first side-branch resonator and a second side-branch resonator acoustically coupled with the acoustic chamber in parallel relative to each other. The acoustic resonator can be arranged to resonate at a selected frequency corresponding to a resonant frequency of the ported acoustic chamber to extend a frequency bandwidth of sound emitted by the electronic device compared to the selected frequency bandwidth emitted by the electroacoustic transducer.

The audio appliance 190 schematically illustrated in FIG. 18 also includes a communication connection 196, as to establish communication with another computing environment. As well, the audio appliance 190 includes an audio acquisition module 191 having a microphone transducer 192 to convert incident sound to an electrical signal, together with a signal conditioning module 193 to condition (e.g., sample, filter, and/or otherwise condition) the electrical signal emitted by the microphone. In addition, the memory 195 can store other instructions that, when executed by the processor, cause the audio appliance 190 to perform any of a variety of tasks akin to a general computing environment.

VII. Acoustic Signal Conditioning

A damped acoustic chamber as described herein can radiate sound over a broader bandwidth and can also require less conditioning of an acoustic signal as compared to a degree of signal conditioning applied to the acoustic signal when played through un-damped acoustic chambers. For example, an amplitude of a signal used to drive a loudspeaker transducer can be diminished at and near the resonant frequency of an un-damped acoustic chamber to de-emphasize that frequency during audio playback. However, such signal conditioning can be computationally intensive. An acoustically damped acoustic chamber described herein can acoustically damp selected frequencies and allow for less signal conditioning and reduce computational overhead during audio playback. Such signal conditioning can be performed in software, firmware, or hardware (e.g., using an ASIC).

VIII. Other Embodiments

The examples described above generally concern acoustic chambers damped with plural resonant chambers, and related systems and methods. The previous description is provided to enable a person skilled in the art to make or use the disclosed principles. Embodiments other than those described above in detail are contemplated based on the principles disclosed herein, together with any attendant changes in configurations of the respective apparatus described herein, without departing from the spirit or scope of this disclosure. Various modifications to the examples described herein will be readily apparent to those skilled in the art.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of damped acoustic enclosures, and related methods and systems. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features claimed herein. Accordingly, neither the claims nor this detailed description shall be construed in a limiting sense, and following a review of this disclosure, those of ordinary skill in the art will appreciate the wide variety of audio appliances, and related methods and systems that can be devised under disclosed and claimed concepts.

Moreover, nothing disclosed herein is intended to be dedicated to the public regardless of whether such disclosure is explicitly recited in the claims. No claim feature is to be construed under the provisions of 35 USC 112(f), unless the feature is expressly recited using the phrase "means for" or "step for".

The appended claims are not intended to be limited to the embodiments shown herein, but are to be accorded the full scope consistent with the language of the claims, wherein reference to a feature in the singular, such as by use of the article "a" or "an" is not intended to mean "one and only one" unless specifically so stated, but rather "one or more". Further, in view of the many possible embodiments to which the disclosed principles can be applied, I reserve to the right to claim any and all combinations of features and technologies described herein as understood by a person of ordinary skill in the art, including, for example, all that comes within the scope and spirit of the following claims.

We currently claim:

1. An electronic earbud device comprising:

an acoustic radiator;

circuitry to drive the acoustic radiator to emit sound over a selected frequency bandwidth;

a housing at least partially defining an acoustic chamber adjacent the acoustic radiator, wherein the housing further defines an acoustic opening extending from the acoustic chamber to a surrounding environment;

an external ear-contact region configured to contact a region of a wearer's ear when the electronic earbud is donned by a wearer; and a first acoustic resonator and a second acoustic resonator, wherein the first acoustic resonator and the second acoustic resonator are acoustically coupled with and extend directly from respective locations around the acoustic chamber in parallel relative to each other and the acoustic opening, each of the first acoustic resonator and the second acoustic resonator configured to modify a frequency response of the acoustic chamber.

2. The electronic earbud device according to claim 1, wherein the first acoustic resonator is arranged to resonate at a corresponding first frequency and the second acoustic resonator is arranged to resonate at a corresponding second frequency.

3. The electronic earbud device according to claim 1, wherein the first acoustic resonator comprises a first resonant chamber and a first duct extending from the acoustic chamber to the first resonant chamber, wherein the second acoustic resonator comprises a second resonant chamber and a second duct extending from the acoustic chamber to the second resonant chamber.

4. The electronic earbud device according to claim 1, wherein the first acoustic resonator comprises a first resonant chamber and a first duct extending from the acoustic chamber to the first resonant chamber, wherein the second acoustic resonator comprises a second resonant chamber and a second duct extending from the first duct to the second resonant chamber.

5. The electronic earbud device according to claim 1, wherein the first acoustic resonator comprises a first resonant chamber and a first duct extending from the acoustic chamber to the first resonant chamber, wherein the second acoustic resonator comprises a resonant conduit extending from a proximal end to a distal end, wherein the proximal end is acoustically coupled with the acoustic chamber.

6. The electronic earbud device according to claim 5, wherein the distal end is open.

7. The electronic earbud device according to claim 5, wherein the distal end is closed.

8. The electronic earbud device according to claim 1, wherein the first acoustic resonator comprises a first resonant conduit extending from a proximal end to a distal end, wherein the proximal end of the first resonant conduit is acoustically coupled with the acoustic chamber, wherein the second acoustic resonator comprises a second resonant conduit extending from a proximal end to a distal end.

9. The electronic earbud device according to claim 8, wherein the distal end of the first resonant conduit is open, wherein the distal end of the second resonant conduit is open.

10. The electronic earbud device according to claim 8, wherein the distal end of the first resonant conduit is open, wherein the distal end of the second resonant conduit is closed.

11. The electronic earbud device according to claim 8, wherein the distal end of the first resonant conduit is closed, wherein the distal end of the second resonant conduit is closed.

12. The electronic earbud device according to claim 8, wherein the first resonant conduit extends longitudinally within the second resonant conduit.

13. The electronic earbud device according to claim 12, wherein the first resonant conduit and the second resonant conduit are spaced apart from each other to define a longitudinally extending gap between the first resonant conduit and the second resonant conduit, wherein the longitudinally extending gap is acoustically coupled with the acoustic chamber at a position adjacent the proximal end of the second resonant conduit.

14. The electronic earbud device according to claim 1, wherein the housing comprises a shell member and a complementarily configured insert having an outer surface with a shape that substantially conforms to a shape of an inner surface of the shell member, wherein the shell member is configured to receive the insert in a mating engagement, wherein, when matingly engaged with each other, the shell member and the insert define an outer boundary of at least a portion of the first acoustic resonator.

15. The electronic earbud device according to claim 14, wherein the insert defines a through-hole aperture open to the acoustic chamber, and the portion of the first acoustic resonator defined by the shell member and the insert.

16. The electronic earbud device according to claim 15, wherein the portion of the first acoustic resonator defined by the shell member and the insert comprises a resonant chamber and wherein the aperture provides a contraction positioned between the acoustic chamber and the resonant chamber.

17. The electronic earbud device according to claim 15, wherein the portion of the first acoustic resonator defined by the shell member and the insert comprises a resonant conduit and wherein the aperture further opens to the resonant conduit such that the aperture extends the resonant conduit to the acoustic chamber.

18. The electronic earbud device according to claim 17, wherein the shell member defines a through-hole aperture extending from the resonant conduit to a surrounding environment.

19. The electronic earbud device according to claim 18, further comprising an acoustic mesh positioned over the through-hole aperture defined by the shell member.

20. The electronic device according to claim 1, wherein the acoustic radiator defines a first major surface and an second major surface, and the acoustic chamber is a first acoustic chamber positioned adjacent the first major surface of the acoustic radiator; wherein the housing further defines, at least partially, a second acoustic chamber positioned adjacent the second major surface of the acoustic radiator.

21. The electronic device according to claim 20, wherein the second acoustic chamber is acoustically sealed.

22. The electronic device according to claim 20, wherein the second acoustic chamber is ported.

23. An electronic earbud device comprising:

an acoustic radiator;

circuitry to drive the acoustic radiator to emit sound over a selected frequency bandwidth;

a housing at least partially defining an acoustic chamber adjacent the acoustic radiator, wherein the housing further defines an acoustic opening extending from the acoustic chamber to a surrounding environment;

an external ear-contact region configured to contact a region of a wearer's ear when the electronic earbud is donned by a wearer; and a first acoustic resonator and a second acoustic resonator, wherein the first acoustic resonator and the second acoustic resonator are acoustically coupled with the acoustic chamber in parallel relative to each other and the acoustic opening, each of the first acoustic resonator and the second acoustic resonator configured to modify a frequency response of the acoustic chamber, wherein the housing comprises a shell member and a complementarily configured insert, wherein the shell member is configured to receive the insert in a mating engagement, wherein, when matingly engaged with each other, the shell member and the insert define an outer boundary of at least a portion of the first acoustic resonator, wherein the insert defines a through-hole aperture open to the acoustic chamber, and the portion of the first acoustic resonator defined by the shell member and the insert, wherein the portion of the first acoustic resonator defined by the shell member and the insert comprises a resonant conduit, and wherein the aperture further opens to the resonant conduit such that the aperture extends the resonant conduit to the acoustic chamber.

24. An earbud, comprising:

an acoustic radiator;

a housing at least partially defining an acoustic chamber adjacent the acoustic radiator, wherein the housing further defines an acoustic opening extending from the acoustic chamber to a surrounding environment; and a first acoustic resonator and a second acoustic resonator, wherein the first acoustic resonator and the second acoustic resonator extend directly from respective locations around the acoustic chamber in parallel with respect to each other and the acoustic opening.

* * * * *